US010591126B2

(12) United States Patent
Mandl

(10) Patent No.: US 10,591,126 B2
(45) Date of Patent: Mar. 17, 2020

(54) MICRO-PROJECTION LIGHT MODULE FOR A VEHICLE HEADLIGHT

(71) Applicant: ZKW Group GmbH, Wieselburg (AT)

(72) Inventor: Bernhard Mandl, Ober-Grafendorf (AT)

(73) Assignee: ZKW GROUP GMBH, Wieselburg (AT)

( * ) Notice: Subject to any disclaimer, the term of this patent is extended or adjusted under 35 U.S.C. 154(b) by 50 days.

(21) Appl. No.: 15/768,317

(22) PCT Filed: Oct. 24, 2016

(86) PCT No.: PCT/AT2016/060087
§ 371 (c)(1),
(2) Date: Apr. 13, 2018

(87) PCT Pub. No.: WO2017/066817
PCT Pub. Date: Apr. 27, 2017

(65) Prior Publication Data

US 2018/0320852 A1 Nov. 8, 2018

(30) Foreign Application Priority Data

Oct. 23, 2015 (AT) ..... 50906/2015

(51) Int. Cl.
*F21S 41/143* (2018.01)
*F21S 41/32* (2018.01)
(Continued)

(52) U.S. Cl.
CPC ..... *F21S 41/143* (2018.01); *F21S 41/24* (2018.01); *F21S 41/265* (2018.01);
(Continued)

(58) Field of Classification Search
CPC ..... F21V 11/186; F21S 41/285; F21S 41/43; F21S 41/265; F21S 41/275; F21S 41/143; F21S 41/24; F21S 41/635; F21S 41/322
See application file for complete search history.

(56) References Cited

U.S. PATENT DOCUMENTS 6,769,777 B1 8/2004 Dubin et al.
2015/0036373 A1* 2/2015 Chen ..... G02F 1/153 362/516
(Continued)

FOREIGN PATENT DOCUMENTS

CH 296715 A 2/1954
DE 2235201 A1 2/1974
(Continued)

OTHER PUBLICATIONS

Office Action issued in Austrian Application No. A 50906/2015, dated Aug. 29, 2016 (4 pages).
(Continued)

*Primary Examiner* — Zheng Song
(74) *Attorney, Agent, or Firm* — Eversheds Sutherland (US) LLP

(57) ABSTRACT

A micro-projection light module (1) for a vehicle headlight, comprising at least one light source (2) and at least one projection arrangement (3) which images the light emitted from the at least one light source (2) into an area in front of the motor vehicle in the form of at least one light distribution, wherein the projection arrangement (3) comprises an entry optics (30) having one, two, or more micro entry optics (31) preferably arranged in an array, and an exit optics (40) having one, two, or more micro exit optics (41) preferably arranged in an array, wherein each micro entry optics (31) is paired with precisely one micro exit optics (41), wherein the micro entry optics (31) are designed in such a way and/or the micro entry optics (31) and the micro exit optics (41) are
(Continued)

Figure 1:
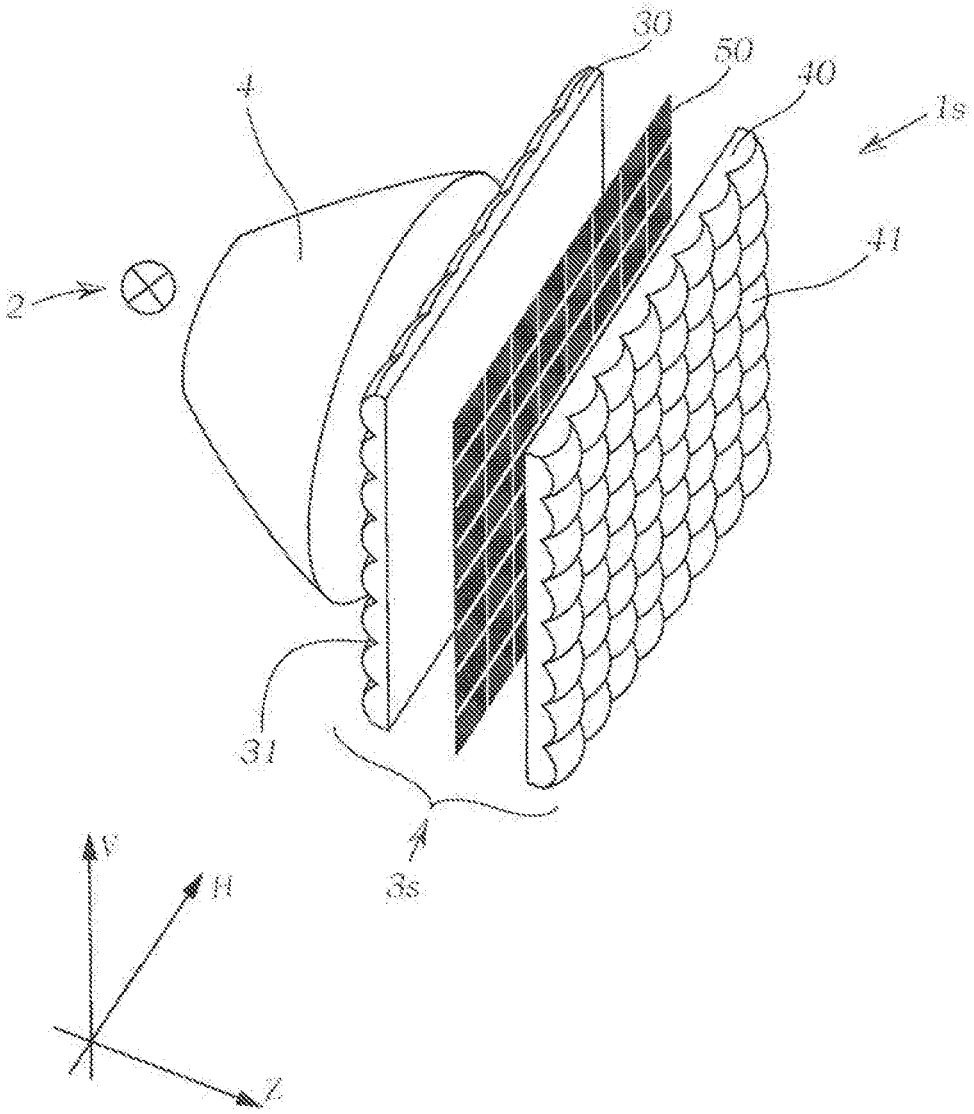

arranged relative to one another in such a way that substantially all the light emitted from a micro entry optics (31) enters precisely only into the paired micro exit optics (41), and wherein the light pre-shaped by the micro entry optics (31) is imaged by the micro exit optics (41) into an area in front of the motor vehicle in the form of at least one light distribution (LV1-LV5; GLV), wherein the at least one light source (2) is paired with an ancillary optics arrangement (4), the at least one light source (2) irradiates the light emitted therefrom into said at least one ancillary optics arrangement (4), said ancillary optics arrangement (4) being designed in such a way that the light emitted therefrom is directed substantially in parallel, and the entry optics (30) having at least one planar boundary surface (31'), wherein the at least one planar boundary surface (31') faces the ancillary optics arrangement (4).

32 Claims, 15 Drawing Sheets

(51) Int. Cl.

| | |
|---|---|
| ***F21S 41/275*** | (2018.01) |
| ***F21S 41/24*** | (2018.01) |
| ***F21S 41/63*** | (2018.01) |
| ***F21S 41/20*** | (2018.01) |
| ***F21S 41/43*** | (2018.01) |
| ***F21S 41/265*** | (2018.01) |

(52) U.S. Cl.
CPC ..... *F21S 41/275* (2018.01); *F21S 41/285* (2018.01); *F21S 41/322* (2018.01); *F21S 41/43* (2018.01); *F21S 41/635* (2018.01)

(56) References Cited

U.S. PATENT DOCUMENTS

| | | | | |
|---|---|---|---|---|
| 2015/0270682 | A1* | 9/2015 | Daniels | G03B 21/2066 353/99 |
| 2016/0010811 | A1* | 1/2016 | Benitez | F21S 41/143 362/509 |
| 2016/0265733 | A1* | 9/2016 | Bauer | G02B 3/0006 |

FOREIGN PATENT DOCUMENTS

| | | |
|---|---|---|
| DE | 3926618 A1 | 2/1991 |
| JP | H2-69405 U | 5/1990 |

OTHER PUBLICATIONS

International Search Report and Written Opinion for PCT/AT2016/060087, dated Mar. 9, 2017 (11 pages).

* cited by examiner

MICRO-PROJECTION LIGHT MODULE FOR A VEHICLE HEADLIGHT

The invention relates to a micro-projection light module for a vehicle headlight, comprising at least one light source and at least one projection arrangement which images the light emitted from the at least one light source into an area in front of the motor vehicle in the form of at least one light distribution, wherein the projection arrangement comprises an entry optics having one, two, or more micro entry optics preferably arranged in an array, and an exit optics having one, two, or more micro exit optics preferably arranged in an array, wherein each micro entry optics is paired with precisely one micro exit optics system, wherein the micro entry optics are designed in such a way and/or the micro entry optics and the micro exit optics are arranged relative to one another in such a way that substantially all the light emitted from a micro entry optics enters precisely only into the paired micro exit optics, and wherein the light pre-shaped by the micro entry optics is imaged by the micro exit optics into an area in front of the motor vehicle in the form of at least one light distribution.

The invention also relates to a lighting device comprising at least one micro-projection light module of this kind.

The invention additionally relates to a motor vehicle headlight comprising at least one lighting device of this kind.

Micro-projection light modules of the above-mentioned kind are known in the prior art. In AT 201350692, in the name of the applicant, a micro-projection light module for a motor vehicle headlight for producing at least one light distribution of a predefined type is disclosed. The problem with a micro-projection light module of this kind is the low optical efficiency and high tolerance sensitivity. The micro-projection light module described in AT 201350692 has up to five optically relevant structural components, wherein each structural component contributes to light losses (losses of optical efficiency) due to light reflections at its boundary surfaces. In addition, this micro-projection light module suffers from a high tolerance sensitivity with respect to the positioning of the individual structural components relative to one another. Positioning tolerances in the region of 0.1 mm lead to displacements by a few degrees in the light image and consequently lead to blurred light patterns.

The object of the present invention is to create a micro-projection light module for a vehicle headlight which has a high optical efficiency and a low tolerance sensitivity with respect to the positioning of the individual structural components and which is additionally characterised by a lower production cost.

This object is achieved with a micro-projection light module of the kind described in the introduction in that, in accordance with the invention, the at least one light source is paired with an ancillary optics arrangement, the at least one light source irradiates the light emitted therefrom into said at least one ancillary optics arrangement, said ancillary optics arrangement being designed in such a way that the light emitted therefrom is directed substantially in parallel, and the entry optics having at least one planar boundary surface, wherein the at least one planar boundary surface faces the ancillary optics arrangement.

Here, it must be noted that the distance between the exit face of the ancillary optics arrangement (ancillary optics arrangement exit face) and the entry face of the entry optics is adjustable, whereby an advantage is provided in the adjustment of the micro-projection light module.

A planar boundary surface of the ancillary optics arrangement for example furthermore has the advantage that, when the light bundled substantially in parallel by the ancillary optics arrangement impinges on the planar boundary surface, there are substantially no reflections at an oblique angle, whereby the light losses can be kept low.

Here, it can be expedient in respect of the optical arrangement if the light emitted from the ancillary optics arrangement impinges on the at least one planar boundary surface.

With regard to the reduction of the light reflections at the entry boundary surface of the entry optics, it can be advantageous if the light emitted from the ancillary optics arrangement irradiates substantially the entire boundary surface.

This can be the case for example if the ancillary optics arrangement exit face and the planar boundary surface are formed congruently and are arranged congruently.

The term "formed congruently" in this context means nothing more than that the ancillary optics arrangement exit face and the planar boundary surface have the same base area shape, with in principle any spatial arrangement. The term "arranged congruently" means that these base areas additionally are also arranged such that they are coincident either directly congruently or are distanced, but would transition congruently into one another if shifted normal to one of the base areas. With regard to the formation of a parallel beam bundle, it can be advantageous of the ancillary optics arrangement is formed as a collimator.

It can be of particular advantage if the ancillary optics arrangement is formed in one piece with the entry optics. As a result, the number of refractive faces reduces by two. The planar collimator exit face and the planar boundary surface are no longer provided in this embodiment. Since any interaction between light and a boundary surface is associated with reflection losses, an increase in efficiency can be attained with this variant. Furthermore, lower production costs are achieved as a result of the one-piece design of the ancillary optics arrangement and the entry optics. A one-piece optically relevant structural component is suitable for plastics injection moulding, whereby the mould for a separate entry optics can be spared and therefore the cost efficiency can be increased.

In addition, it can be provided that a micro entry optics and a micro exit optics paired with the micro entry optics form a micro-optics system, which micro-optics system comprises at least one micro-optics focal point.

With regard to the production of the light pattern, it can be expedient if each entry optics focuses the light passing therethrough into the at least one micro-optics focal point.

Furthermore, it can be advantageous if a micro-optics focal point of each micro entry optics lies before the paired micro exit optics in the light emission direction, wherein the micro entry optics focus the light passing therethrough in the vertical direction in each case onto the micro-optics focal points lying before the micro exit optics, and wherein the micro exit optics have a focal point coincident in each case with the micro-optics focal point of the paired micro entry optics.

Light is thus focused into the focal point of the micro-optics system and is then collimated accordingly in the vertical direction after having passed through the micro exit optics and is projected into an area in front of the vehicle.

With regard to the production of light distributions, it can be advantageous if each micro-optics system widens the light passing therethrough in the horizontal direction.

To this end, each micro-optics system focuses the light passing through in the vertical direction onto a micro-optics focal point, which preferably lies after the micro entry optics and before the micro exit optics. This light then passes through the micro exit optics and is now focused in the horizontal direction in a focal point line preferably after the micro exit optics.

Here, the terms "before" and "after" relate to the main direction of propagation of the light emitted from the micro-projection light module.

With regard to the losses by total reflection of the light as it exits from the entry optics, it can be advantageous if each micro entry optics has a curved boundary surface, which curved boundary surface has a minimum radius of curvature value. The light that has infiltrated the entry optics through the planar boundary surface thus exits at the curved boundary surface. In so doing, the lights exits from a medium having a higher refractive index (for example glass, plastic, etc.) compared to the medium (for example air) infiltrated by the light. Here, total reflections and therefore the additional light losses can occur at this boundary surface, as is known. It is therefore advisable to maintain a certain minimum value of the radii of curvature of those boundary surfaces of the micro entry optics at which the light exits from the micro entry optics, and thus keep the total reflections low.

It can be expedient if each micro entry optics is formed as a collecting optics or as a free-form optics or as a Fresnel lens.

In addition, it can be advantageous if each micro exit optics is formed as a projection optics or as a spherical lens or as an aspherical lens or as a free-form lens or as a Fresnel lens.

For structural reasons, it can be advantageous if boundary surfaces of micro entry optics and micro exit optics paired with one another facing the ancillary optics arrangement are formed congruently with one another, preferably in a planar manner, and preferably are also arranged congruently with one another.

The term "formed congruently" in this context means nothing more than that the micro-optics paired with one another have the same base area shape, with in principle any spatial arrangement. The term "arranged congruently" means that these base areas additionally are also arranged such that they are coincident either directly congruently or are distanced, but would transition congruently into one another if shifted normal to one of the base areas.

With regard to the reduction of aberrations, it can be advantageous if the optical axes of micro entry optics and micro exit optics paired with one another run parallel to one another, and preferably are coincident.

It can be provided advantageously that at least one first screen device is arranged between the entry optics and the exit optics.

Here, it is particularly advantageous if the first screen device lies in a plane spanned by the micro-optics focal points, wherein the first screen device for at least one pair of micro entry and micro exit optics paired with one another, preferably for a plurality of pairs, and in particular for all pairs comprises a screen having in each case at least one, for example precisely one, optically effective screen edge.

Use of the first screen device can be advantageous if it is desired to produce light distributions of different types. Here, the light pattern is trimmed with the aid of the optically effective screen edges and is adapted to the desired light pattern (see also FIGS. 3, 3*a*, 3*b*).

In addition, it can be expedient if at least one second screen device is arranged between the entry optics and the exit optics.

Here, it can be provided that the second screen device is arranged between the first screen device and the exit optics.

It can be provided additionally that the second screen device is arranged between the entry optics and the first screen device.

Furthermore, it can be advantageous if the second screen device for at least one pair of micro entry and micro exit optics paired with one another, preferably for a plurality of pairs, and in particular for all pairs comprises a screen having in each case at least one, for example precisely one, optically effective screen edge.

Figure 4:
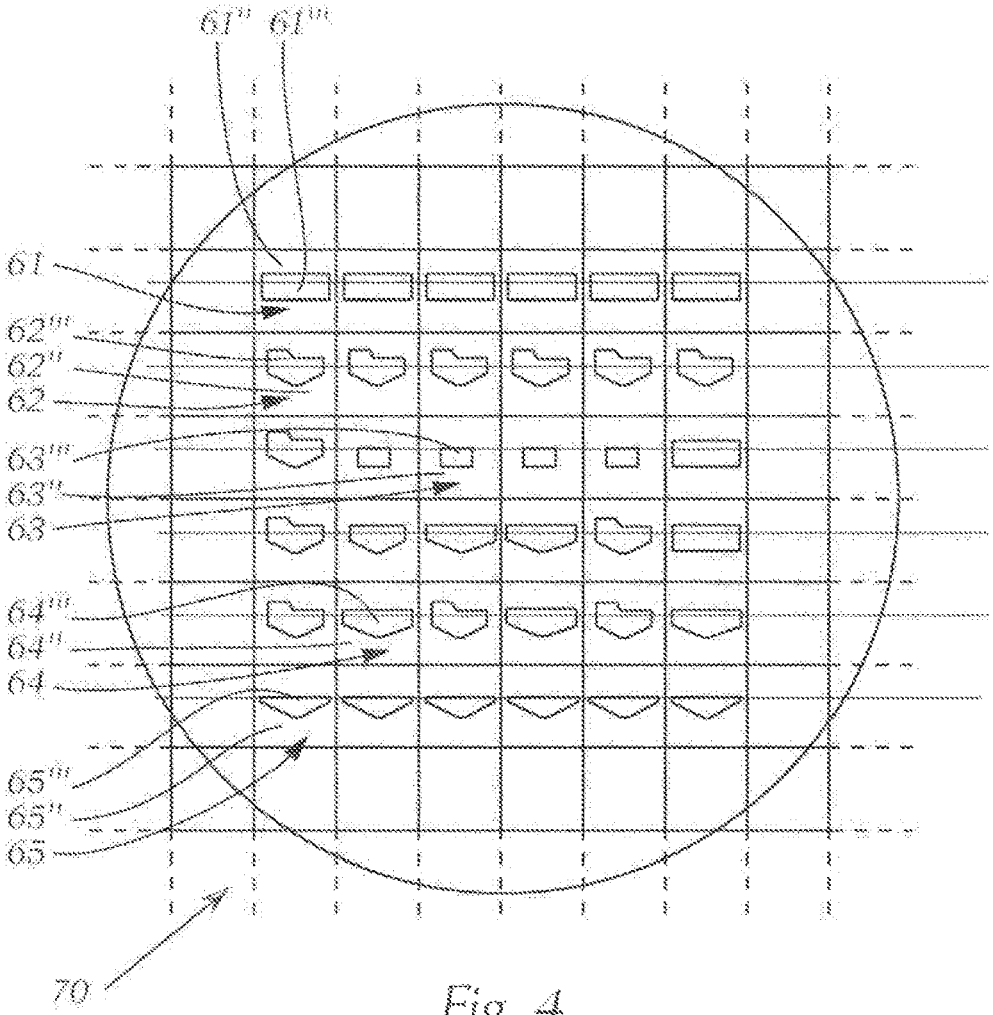
Figure 4A:
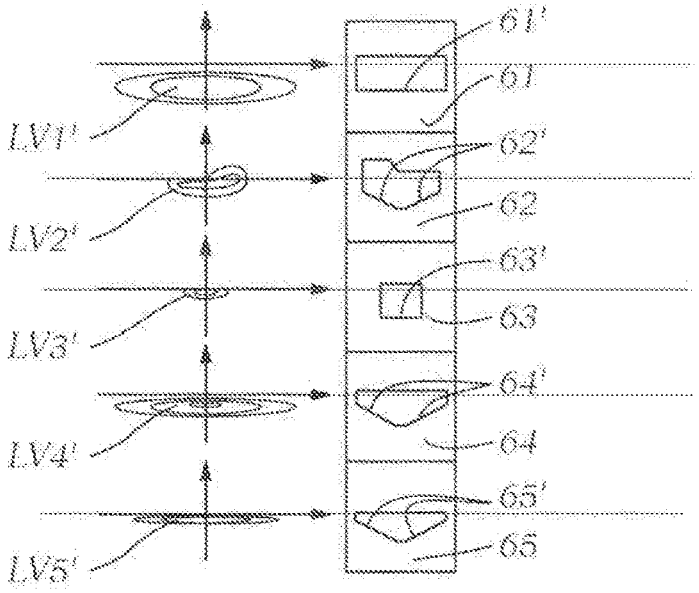
Figure 5:
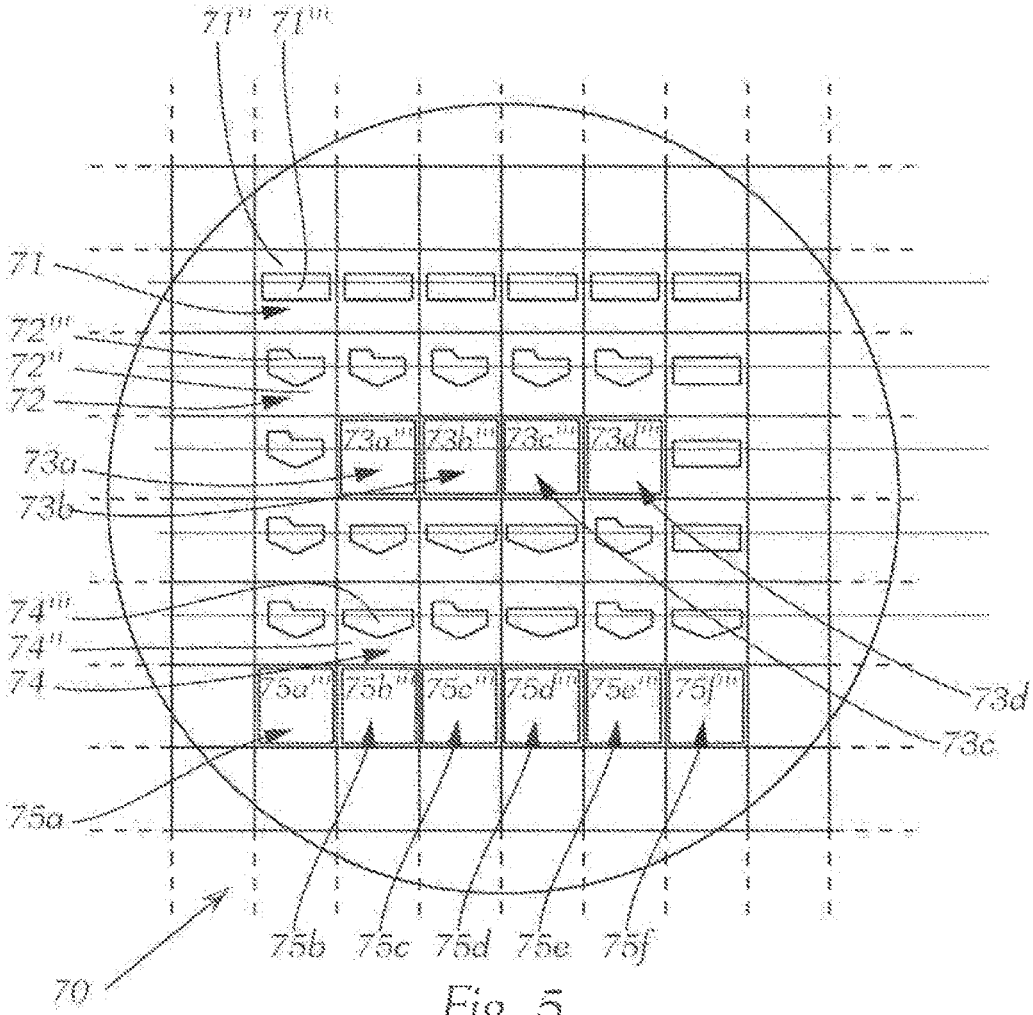
Figure 5A:
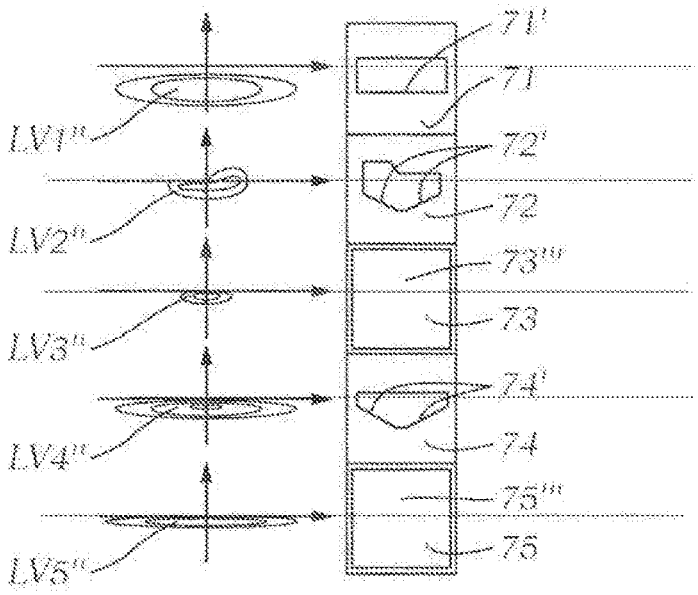

Introducing a second screen device makes it possible to reduce or correct the aberrations resulting from the crosstalk between the micro-optics systems, i.e. when the light enters one micro-optics system, but exits from another, usually in adjacent micro-optics system, and/or resulting from aberration of the light (see also FIGS. 4*a* and 5*a*).

With regard to the production of the second screen device, it can be advantageous if all screens of the second screen device have identical screen edges.

With regard to an improved correction of the aberrations, it can be expedient if at least two screens of the second screen device have screen edges of different design.

Here, it can be advantageous if at least one of the optically effective screen edges has a gable-like course.

In addition, it can be provided that at least one upper or one lower (with respect to the vertical direction) optically effective screen edge of the screen has a sloping course, rising from the optical axis outwardly towards the screen.

With regard to the production, it can be expedient if the first screen device and the second screen device are identical.

In a proven embodiment it is provided that the exit optics is formed in one piece with the at least one second screen device.

Here, it can be expedient if the second screen device is arranged on the boundary surface of the exit optics facing the entry optics.

In principle, a projection arrangement, as described above, comprises a plurality of micro-optics systems, i.e. pairs consisting in each case of a micro entry optics and a micro exit optics. In the simplest embodiment without screen devices, all micro-optics systems produce the same light distribution, which (partial) light distributions together form a main beam distribution, for example. Here, it is assumed for the sake of simplicity that a complete light distribution is produced by precisely one micro-projection light module. However, it can also be provided in practice that two or also more micro-projection light modules according to the invention are used to produce the total light distribution. This can be expedient for example if, for example for space reasons, it is necessary to distribute the components among different positions within the headlight.

In order to produce a dimmed light distribution, for example a dipped beam distribution, which has a light-dark boundary as is known, it can now be provided that each micro-optics system is paired with more or fewer identical screens in the beam path, such that all micro-optics systems produce a light distribution having a light-dark boundary. The superimposition of all light distributions then gives the dimmed light distribution as total light distribution.

Here, the screens in this case and in all other cases can be embodied as individual screens (for example in the form of an impermeable layer, for example a layer produced by vapour deposition, etc.), which "form" the first screen device, however a screen device component can also be used, for example a flat film, etc., in which corresponding openings are provided for the passage of light. Here, as mentioned above, aberrations occur, which can now be reduced by the insertion of the second screen device.

In addition, it can also be provided that different screens are provided, i.e. that one or more micro-optics systems is/are paired with a first screen of the first screen device and a second screen of the second screen device, one or more other micro-optics systems is/are paired with at least one other screen of the first screen device identical to the first screen or different from the first screen (or no screen) and another screen of the second screen device identical to the second screen or different from the second screen (or no screen), etc., such that different micro-optics systems form different light distributions. By selective activation of individual micro-optics systems (for which purpose, however, it is necessary for these to be paired with dedicated light sources that can be separately controlled, at least in groups), individual different light distributions can in this way be produced, which can also be operated in superimposition.

Furthermore, it can be expedient if the projection arrangement consisting of entry optics and exit optics is formed from two components separated from one another and the exit optics is mounted displaceably in relation to the entry optics, wherein the exit optics and/or the second screen device (in the installed position of the micro-projection light module) is displaceable in the vertical and/or horizontal direction and/or parallel to the entry optics.

Here, it can be particularly advantageous if an actuator, preferably a piezoactuator, is provided in order to displace the exit optics and/or the second screen device in each direction.

In this embodiment of the micro-projection light module according to the invention, a user-friendly adjustment of the projection arrangement is provided.

In addition, it can be advantageous if the light source comprises at least one semiconductor-based light source, which semiconductor-based light source preferably has one, two or more LEDs and/or laser diodes, wherein the LEDs and/or laser diodes preferably can be controlled independently of one another.

The term "can be controlled" is to be understood here primarily to mean switching on and off. In addition, this term can also be understood to include the dimming of the LEDs (light-emitting diodes) and/or laser diodes of the light sources.

Furthermore, it can be provided that in the case of two or more light sources for the micro-projection light module, the light sources can be controlled independently of one another.

The term "independently of one another" is to be understood here to mean that all light sources can in fact be controlled independently of one another, or that the light sources can be controlled independently of one another in groups.

It can also be provided that each micro-optics system consisting of a micro entry optics and a micro exit optics is paired with precisely one, preferably semiconductor-based light source, which preferably comprises precisely one light-emitting diode (LED) or precisely one laser diode.

In a proven embodiment it is provided that two or more light source groups are provided, wherein each light source group comprises at least one light source, and wherein the light sources of a light source group emit light of the same colour, and wherein the light sources of different light source groups emit light of different colour, and wherein each light source group illuminates a region of the at least one projection arrangement paired specifically with this light source group, and wherein the different regions are of identical design or are designed to produce identical light distributions.

Here, it should be noted that the position of the first screen device and/or of the second screen device and/or the form of the entry optics (for example the thickness of the particular entry optics and/or the curvatures of the micro entry optics forming the entry optics) should be adapted to the particular light source group. As mentioned above, the first screen device is preferably arranged in the focal area of the projection arrangement. As a result of the dispersion (dependency of the refractive index on the wavelength of light) of the material of which the entry and exit optics are made, the positions of the focal points of the micro-optics systems for each colour (green, red, or blue) are different. As a result, the focal areas of the parts of a same projection arrangement irradiated for example with red, green or blue light or of the irradiated projection arrangements are not necessarily coincident. This can lead in turn to chromatic aberrations (longitudinal and/or lateral chromatic aberrations) in the light pattern (in the irradiated light distribution, if the position of the first screen device and possibly also the second screen device is adapted to the colour of the light irradiated from the light sources.

Here, it can be expedient if three light source groups are provided, wherein one light source group preferably emits red light, one light source group preferably emits green light, and one light source group preferably emits blue light.

The objects stated in the introduction are also achieved with a lighting device for a vehicle headlight which comprises at least one, preferably two or more micro-projection light modules as described above.

In a preferred embodiment it can be provided that two or more groups of micro-projection light modules are provided, and wherein each group comprises one, two, or more micro-projection light modules, wherein micro-projection light modules of one group produce the same light distribution, and wherein micro-projection light modules of different groups produce different light distributions, wherein the light sources of each group of micro-projection light modules can be controlled independently of the light sources of the other groups.

Here, it can be advantageous if the projection arrangements of micro-projection light modules of a group form a common component.

A particular advantage, however, results if the projection arrangements of all micro-projection light modules form a common component.

It can therefore be expedient if two or more groups are provided for producing different light distributions, wherein each group forms a different light distribution selected from one of the following light distributions:

*) turning beam light distribution;

*) town beam light distribution;

*) country road beam light distribution;

*) motorway beam light distribution;

*) light distribution for additional light for motorway beam;

*) cornering beam light distribution;

*) dipped beam light distribution;

*) dipped beam front-end light distribution;

*) light distribution for asymmetrical dipped beam in the far field;

*) light distribution for asymmetrical dipped beam in the far field in cornering beam mode;

*) full beam light distribution;

*) glare-free full beam light distribution.

It has also proven to be favourable, not just only, but in particular with the use of laser light sources, when the lighting device comprises two or more micro-projection light modules, wherein each micro-projection light module has at least one light source group, wherein each light source group comprises at least one light source, and wherein light sources in the same light source group emit light of the same colour, and wherein at least two light source groups are provided which emit light of different colours, and wherein each light source group illuminates a region of the at least one projection arrangement of its micro-projection light module paired in a dedicated manner with this light source group, and wherein the different regions are identical, or are configured for the production of identical light distributions.

A particularly advantageous embodiment is to provide three groups of light source groups, wherein one group of light source groups preferably emits red light, one group of light source groups preferably emits green light, and one group of light source groups preferably emits blue light, and wherein each group of light source groups comprises at least one light source group.

Figure 2:
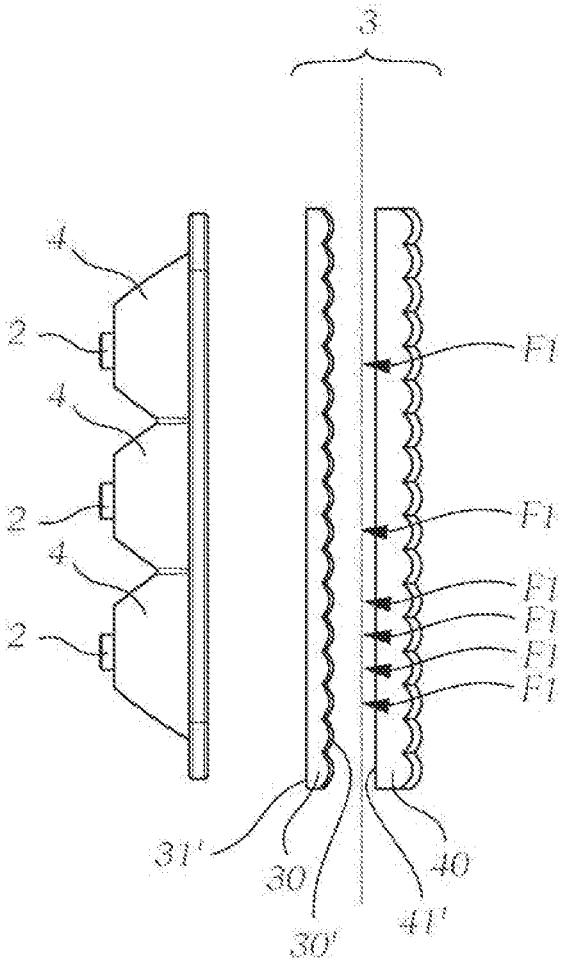
Figure 2B:
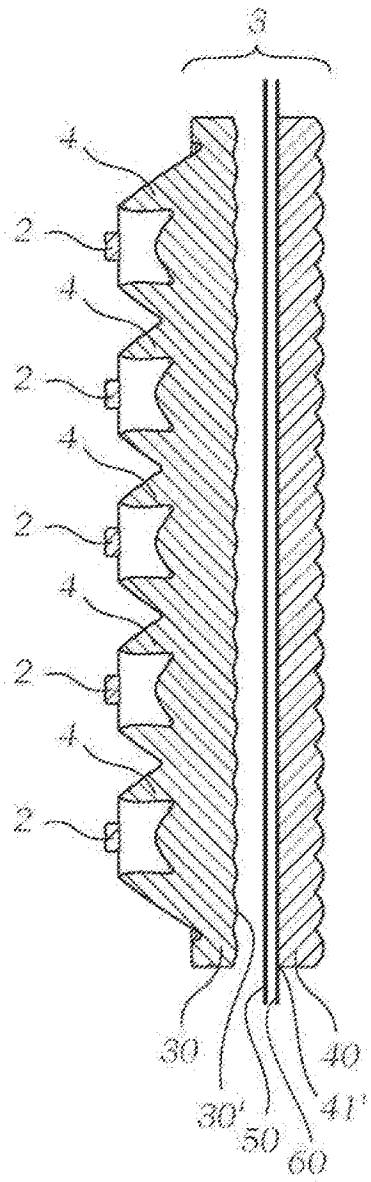
Figure 2A:
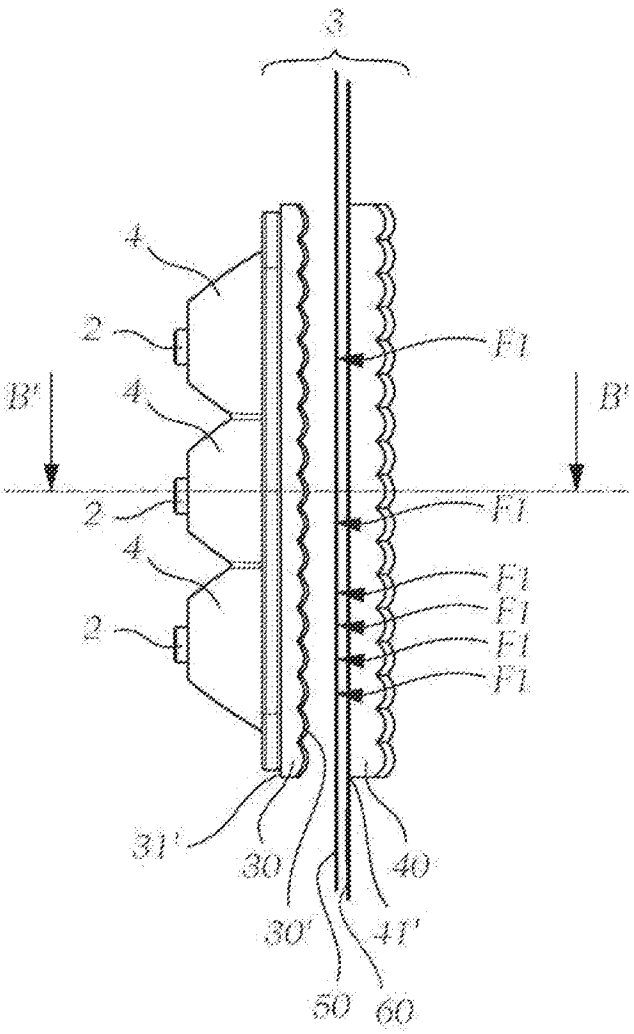
Figure 2C:
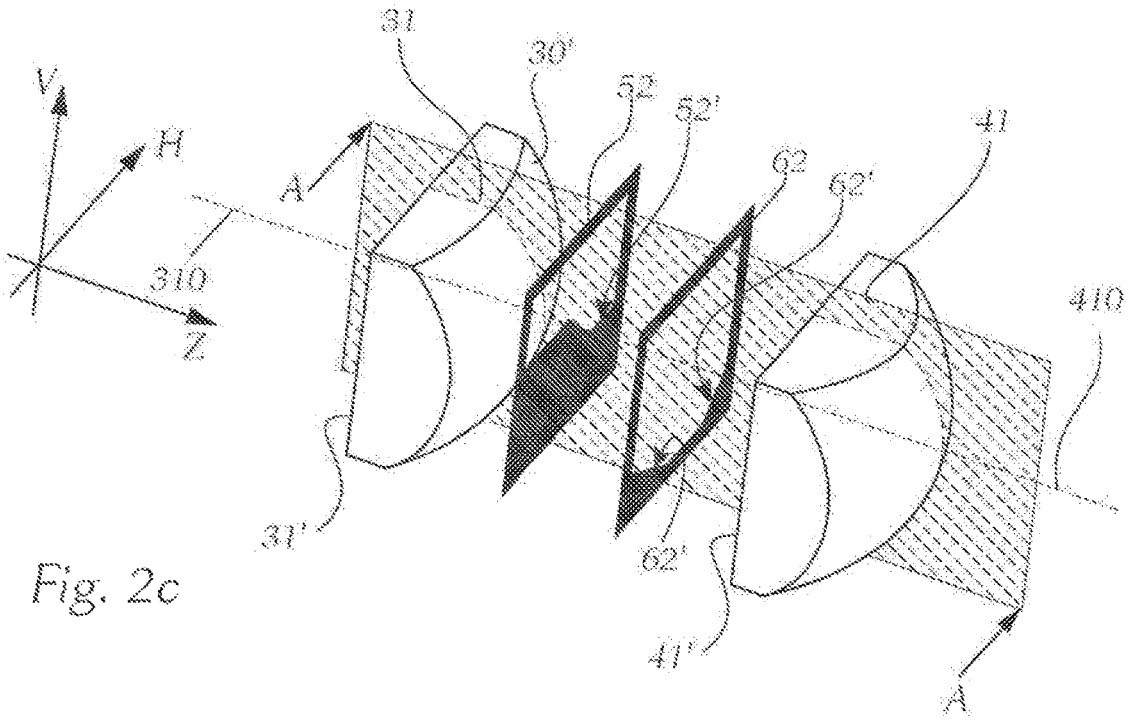
Figure 2D:
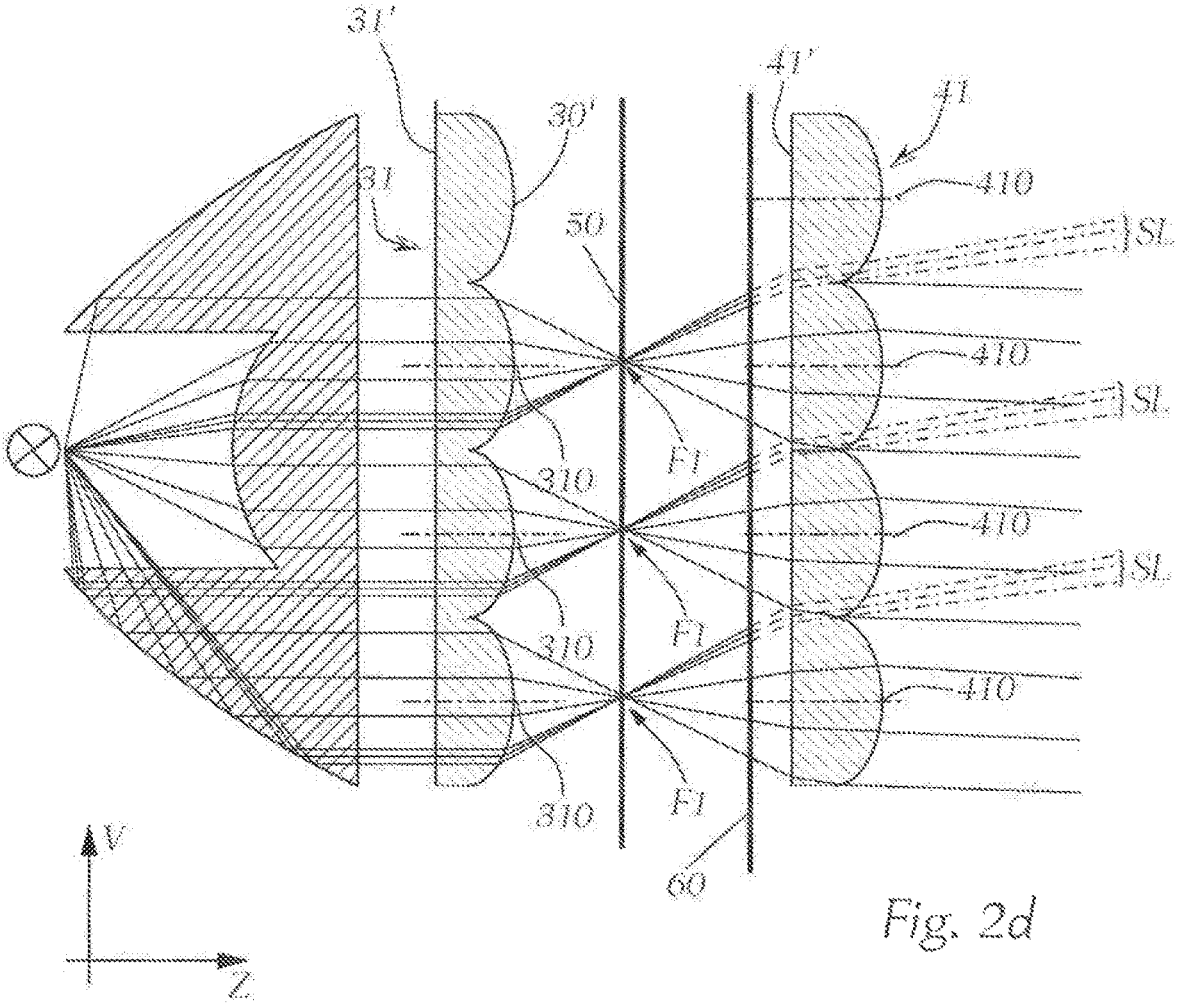
Figure 2E:
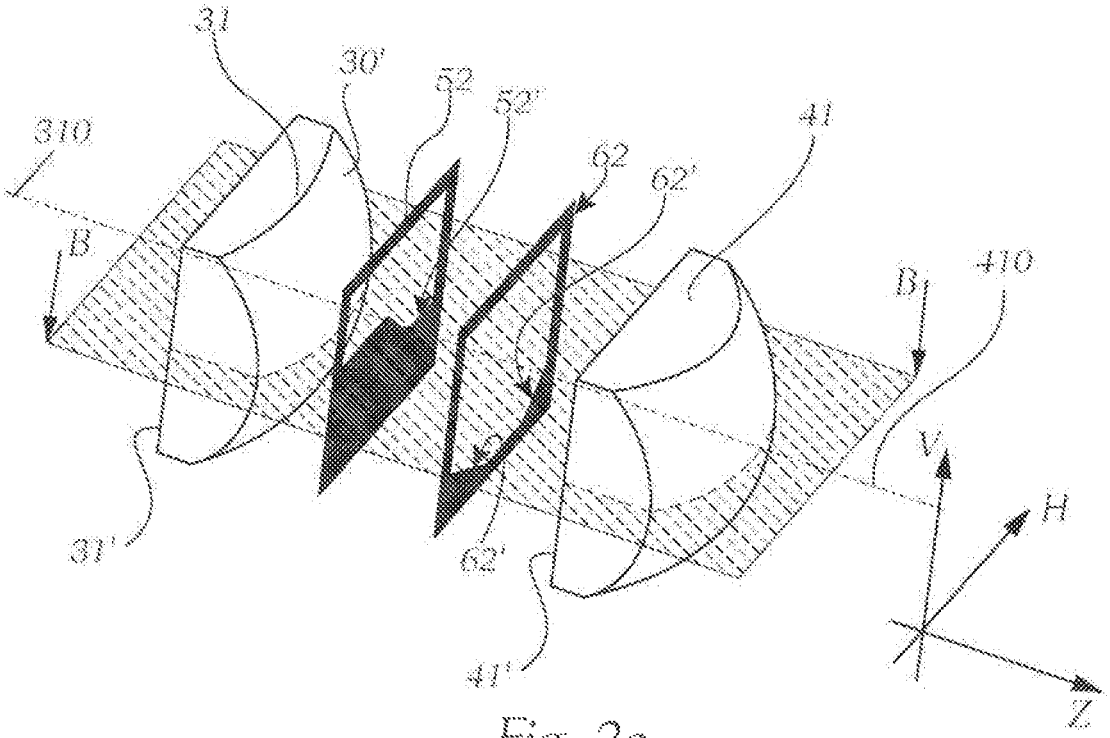
Figure 2F:
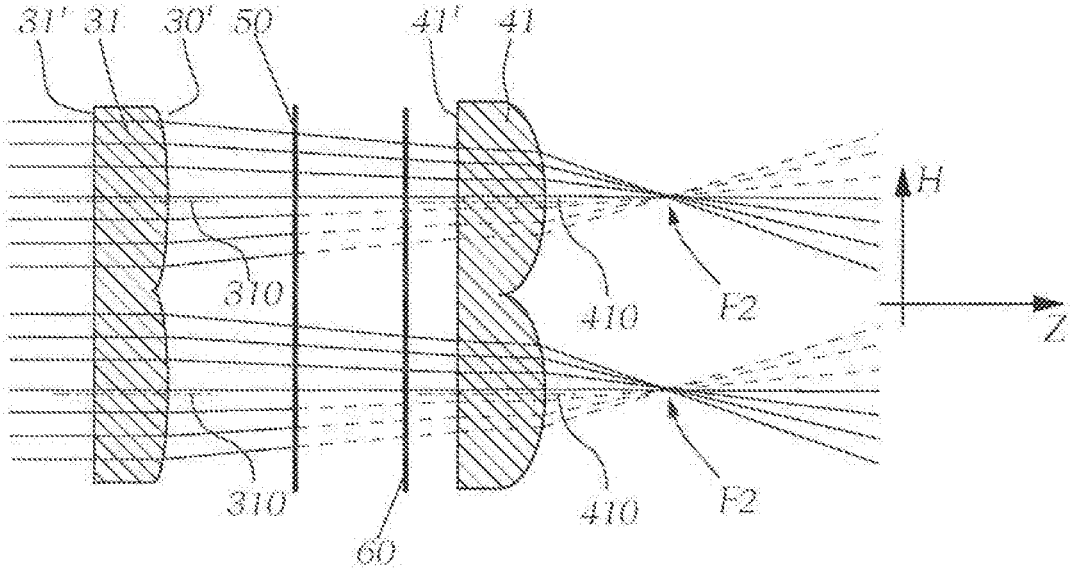
Figure 3B:
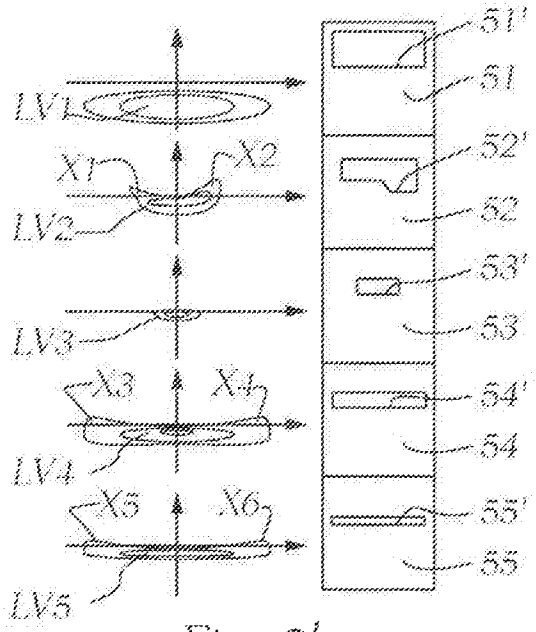
Figure 3A:
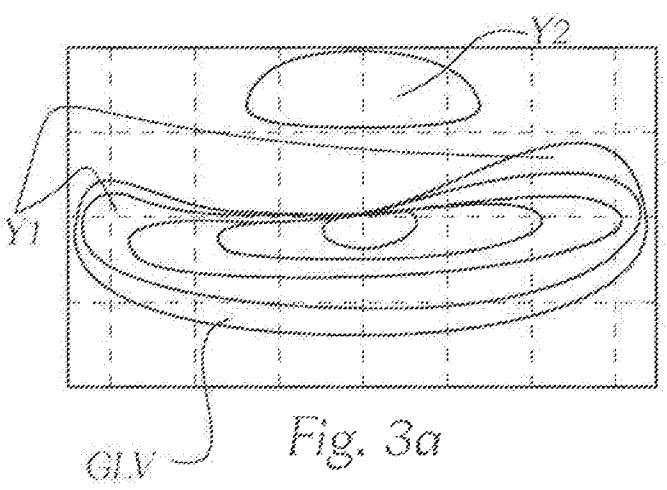
Figure 3:
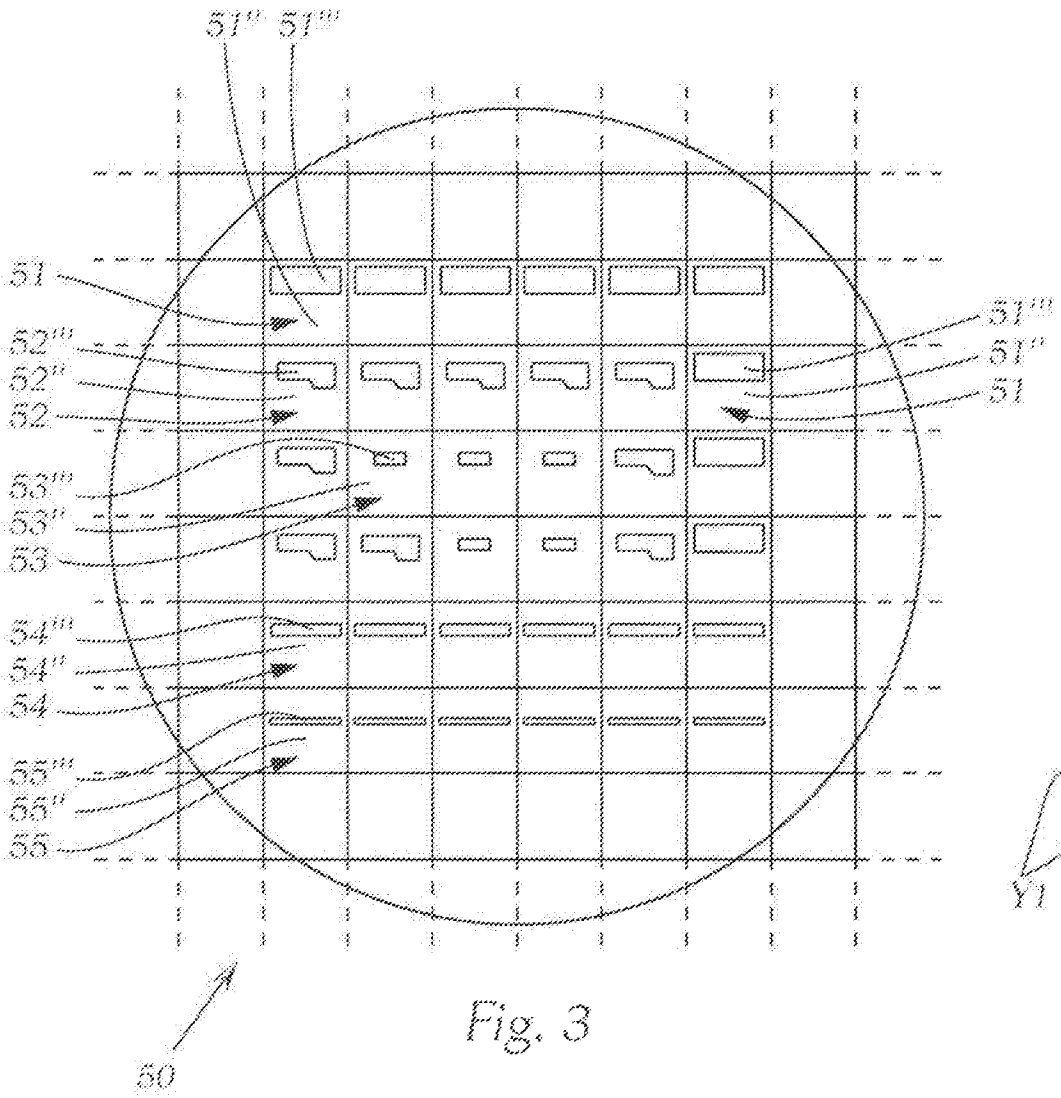
Figure 6A:
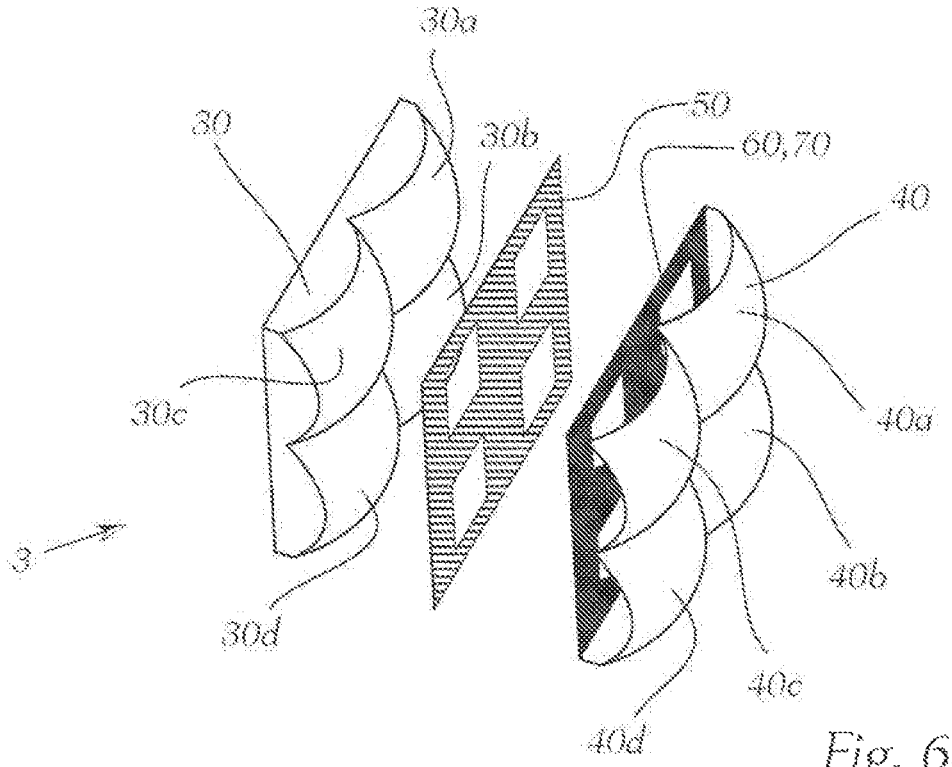
Figure 6B:
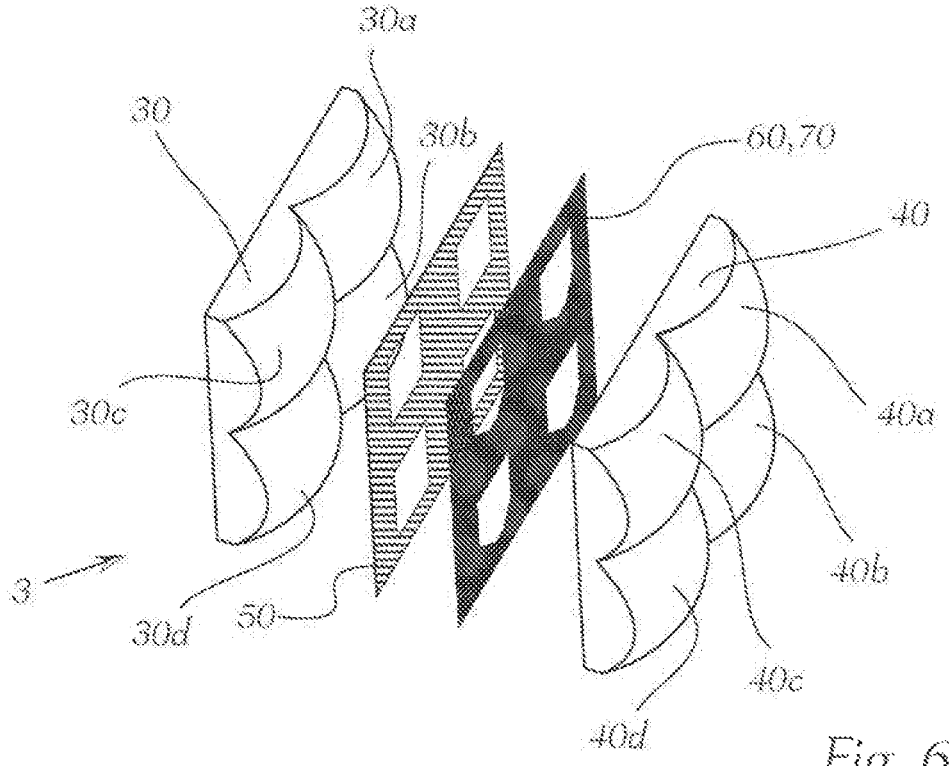
Figure 7:
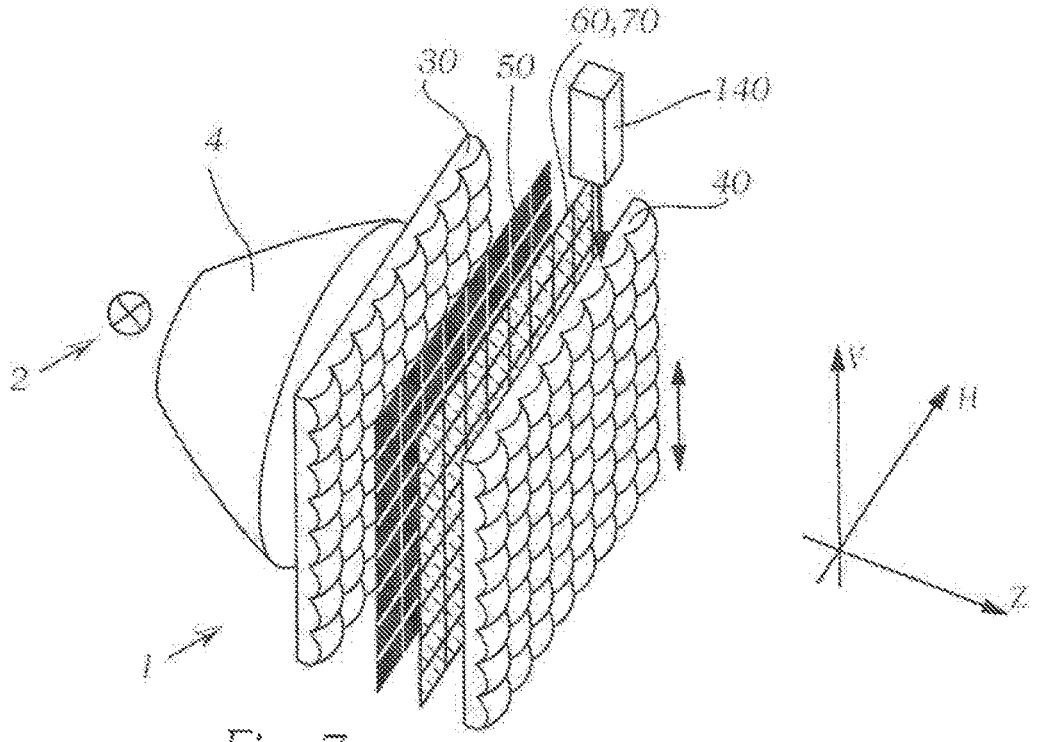
Figure 8:
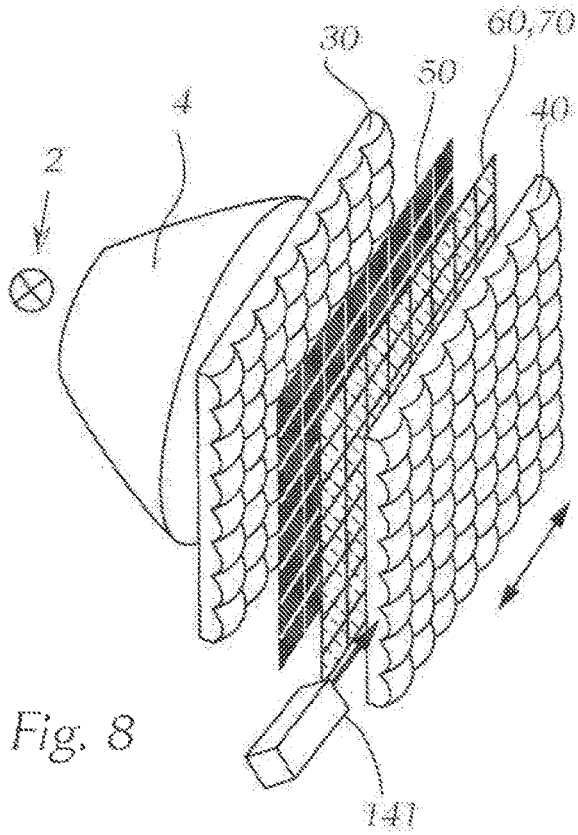
Figure 9:
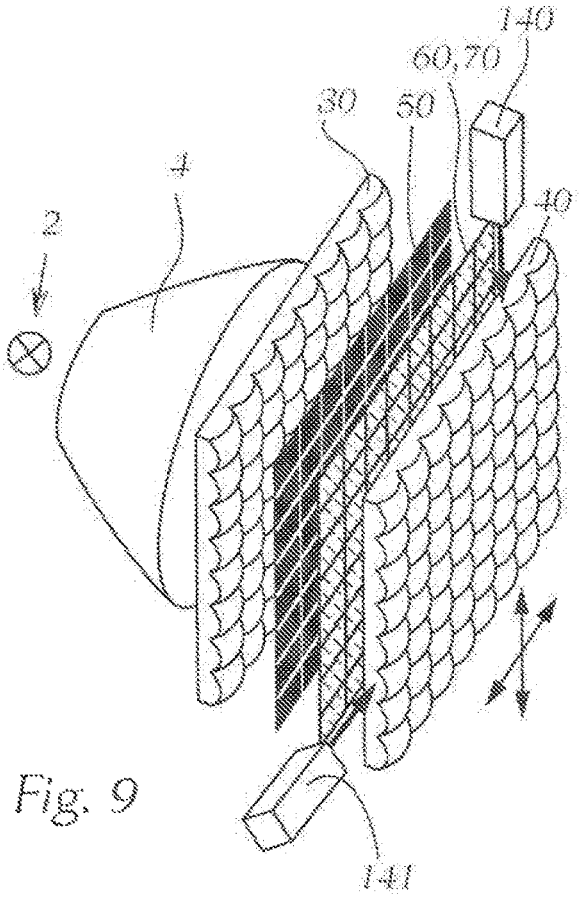
Figure 10A:
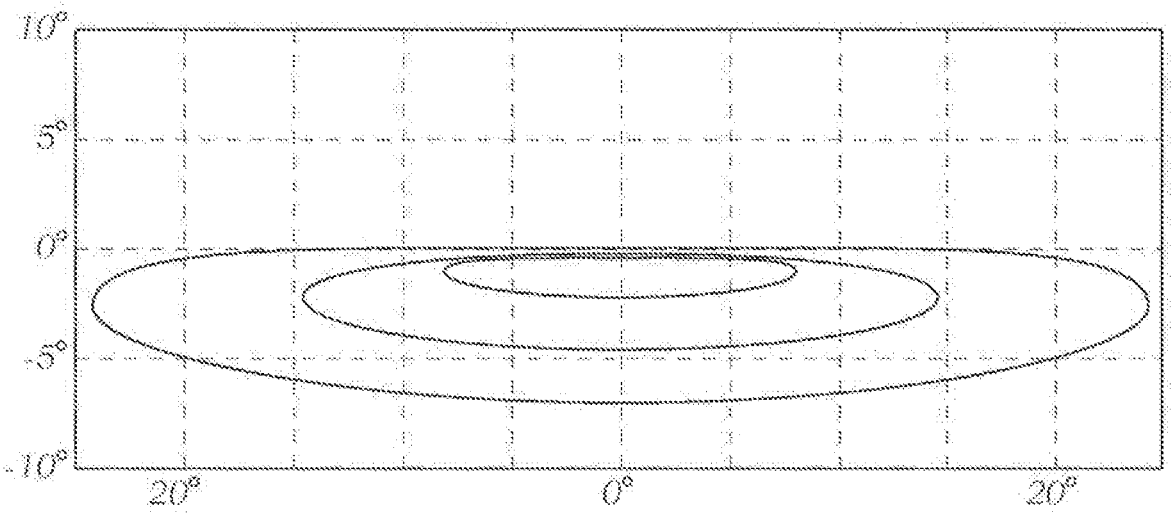
Figure 10B:
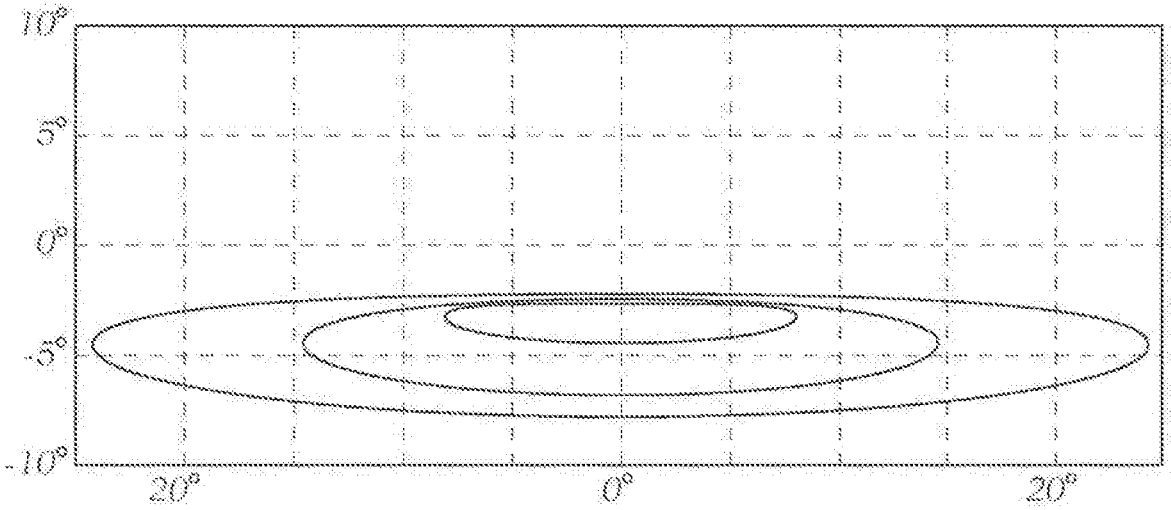
Figure 10C:
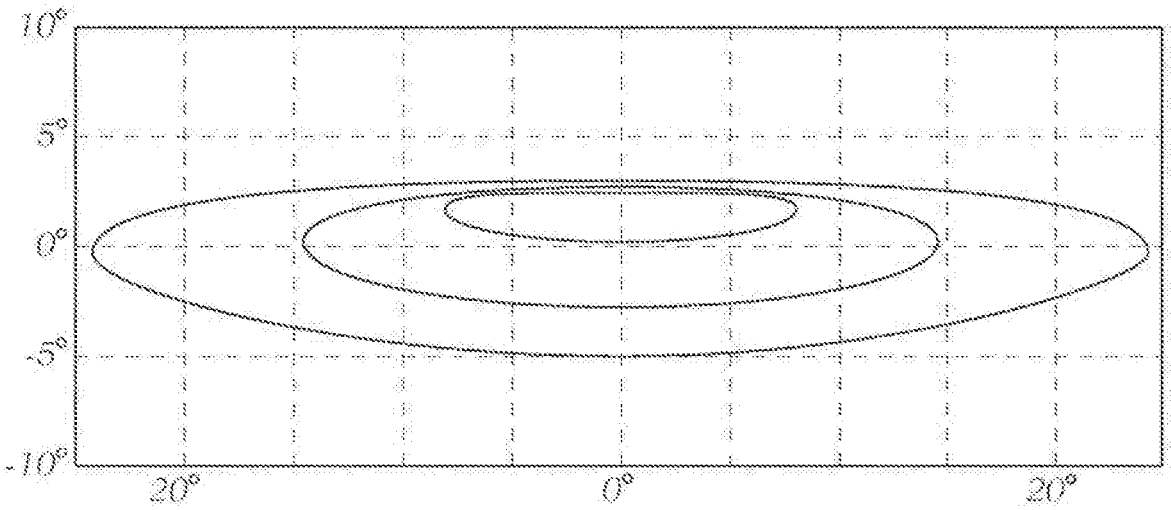
Figure 11A:
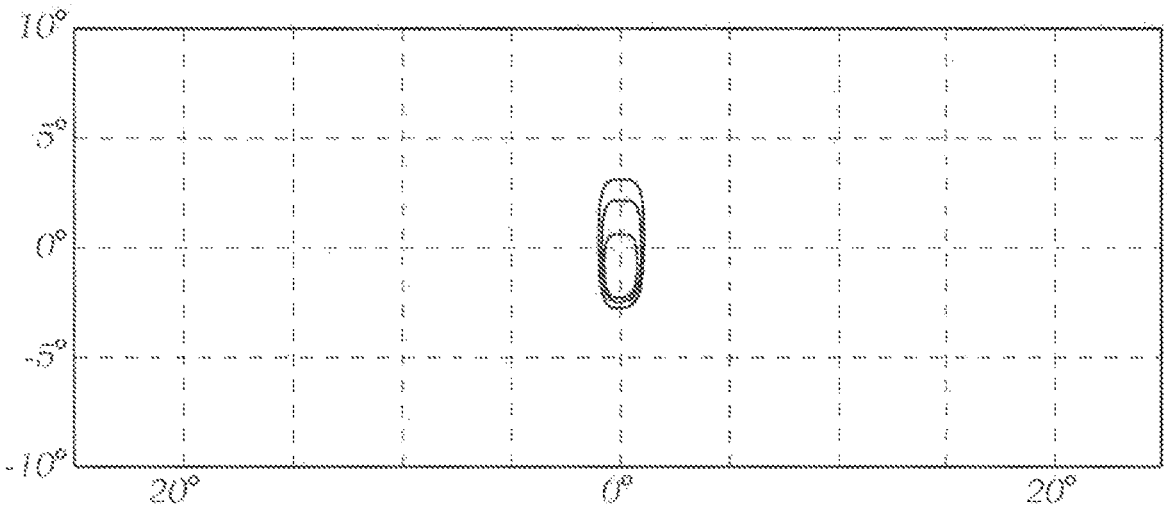
Figure 11B:
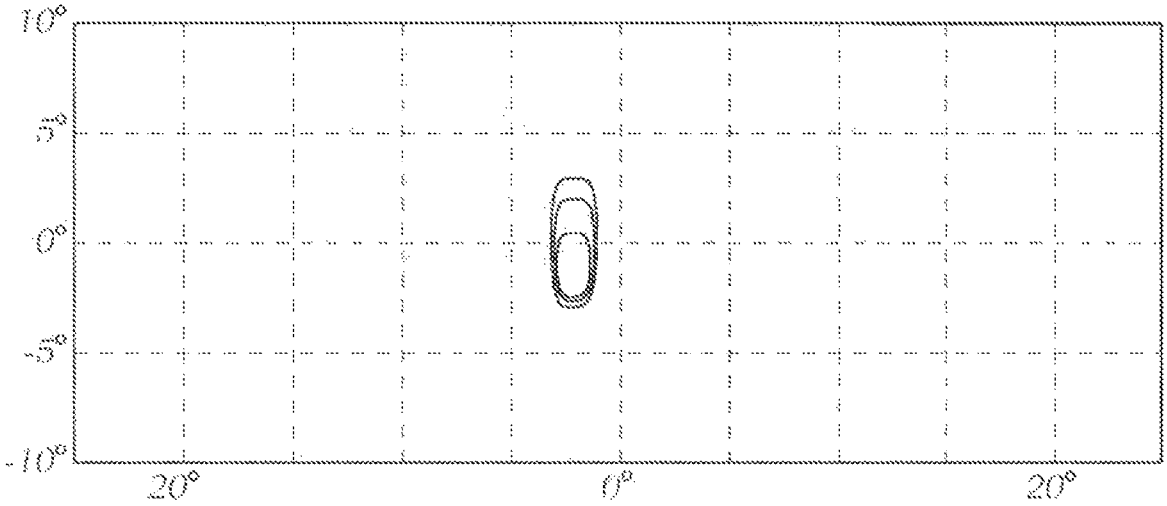
Figure 11C:
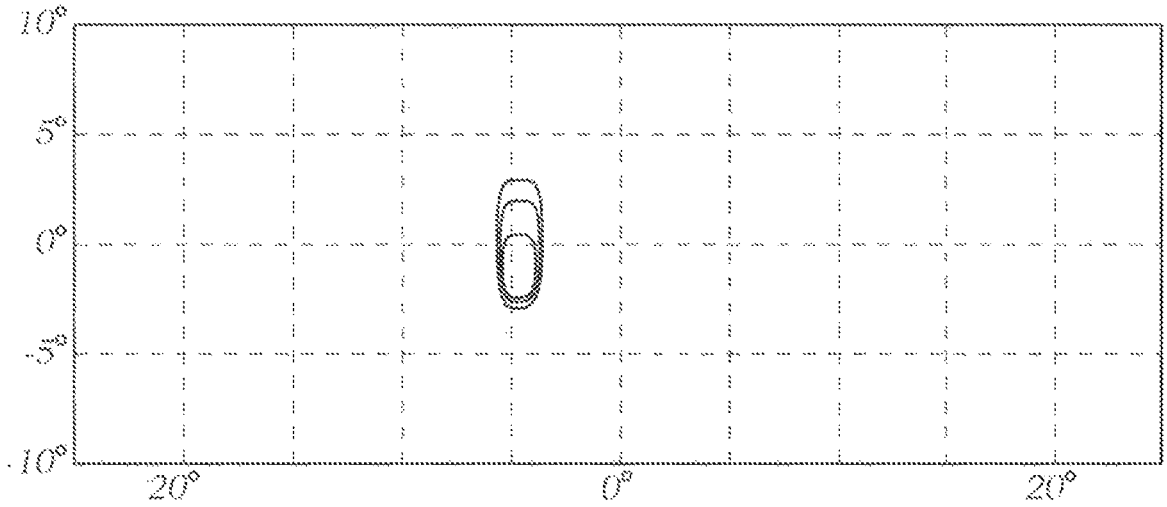
Figure 12:
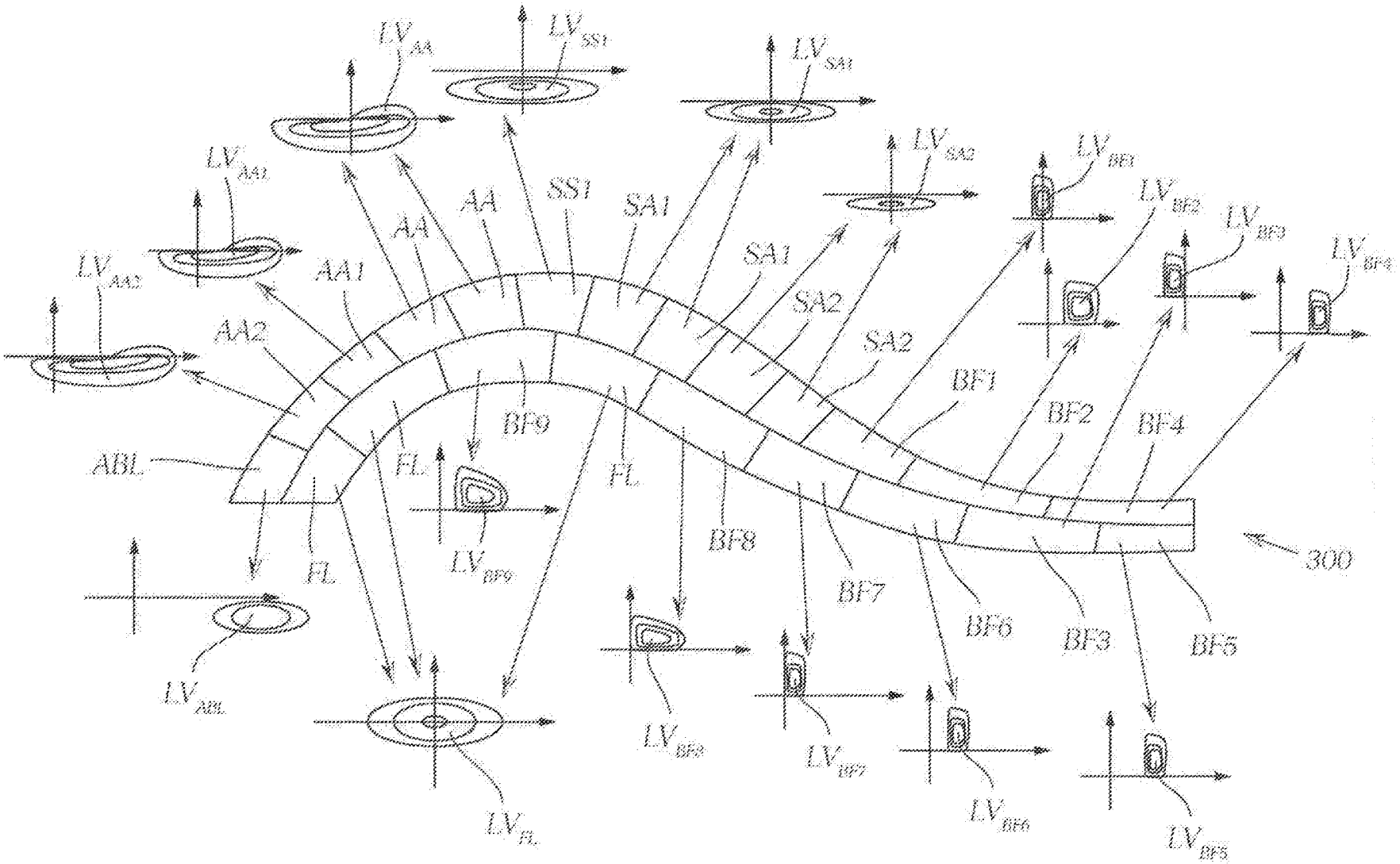
Figure 13A:
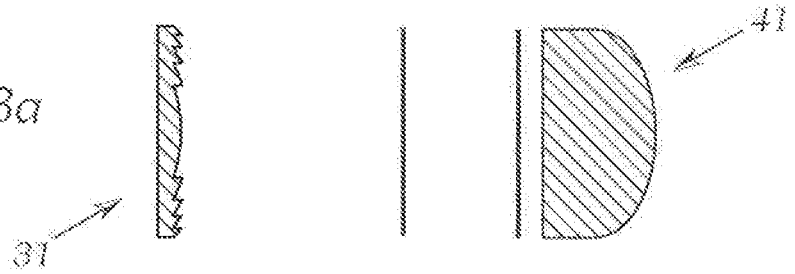
Figure 13B:
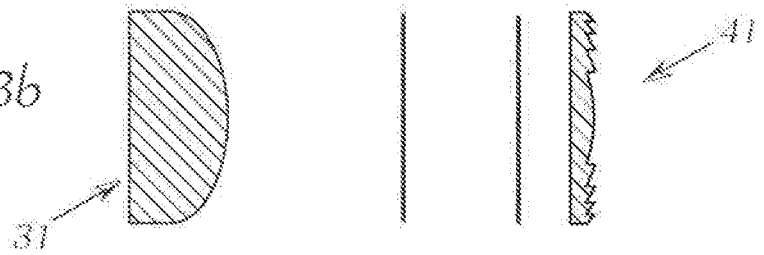
Figure 13C:
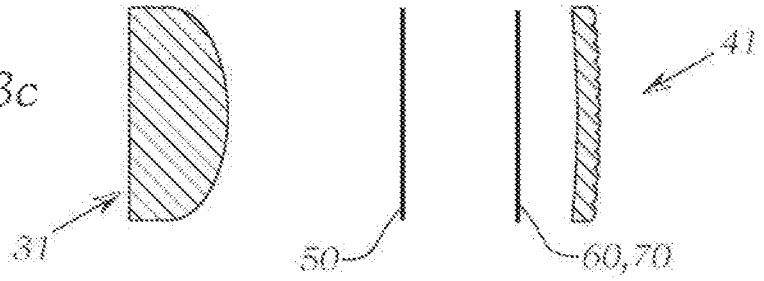
Figure 14A:
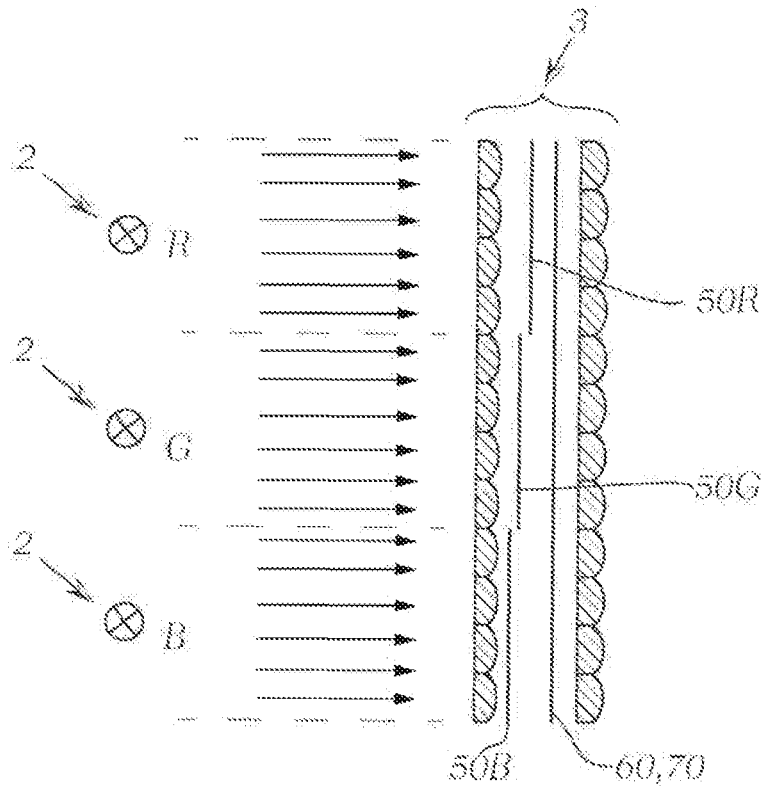
Figure 14B:
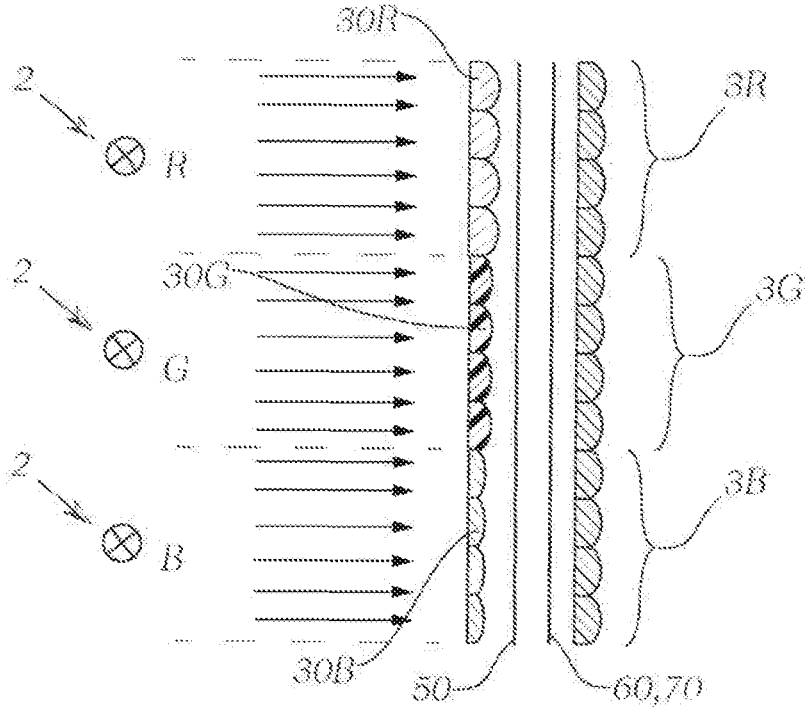

The invention will be explained in greater detail hereinafter on the basis of exemplary non-limiting embodiments, which are illustrated in a drawing, in which FIG. 1 shows a schematic illustration of a micro-projection light module according to the prior art in an exploded illustration, FIG. 2 shows a schematic illustration of a micro-projection light module according to the invention in a side view, FIG. 2*a* shows a development of the micro-projection light module of FIG. 2 in a side view, FIG. 2*b* shows a section through the micro-projection light module of FIG. 2*a* along the line B'-B', FIG. 2*c* shows a schematic illustration of a micro-optics system of a micro-projection light module according to the invention in a perspective view and a vertical plane of section, FIG. 2*d* shows a section through the micro-optics system of FIG. 2*c* along the plane A-A, FIG. 2*e* shows the micro-optics system of FIG. 2*c*, with a horizontal plane of section, FIG. 2*f* shows a section through the micro-optics system of FIG. 2*e* along the plane B-B, FIG. 3 shows a schematic illustration of a first screen device with one, two, or more screens, FIG. 3*a* shows a schematic illustration of a total light distribution with aberrations, produced with a light module having the first screen device of FIG. 3, FIG. 3*b* shows the partial light distributions with aberrations, produced with the individual screens of the first screen device of FIG. 3, which jointly form the total light distribution of FIG. 3*a*, FIG. 4 shows a first variant of a second screen device, FIG. 4*a* shows the partial light distributions without aberrations, produced with the individual screens of the second screen device of FIG. 4, FIG. 5 shows a second variant of the second screen device, FIG. 5*a* shows the partial light distributions without aberrations, produced with the individual screens of the second screen device of FIG. 5, FIG. 6*a* shows a detail of a micro-projection light module according to the invention comprising four micro-optics systems, wherein each micro-optics system is formed in three parts, FIG. 6*b* shows a detail of a micro-projection light module according to the invention comprising four micro-optics systems, wherein each micro-optics system is formed in four parts, FIG. 7 shows a micro-projection light module with an actuator for displacing the exit optics in the vertical direction, FIG. 8 shows a micro-projection light module with an actuator for displacing the exit optics in the horizontal direction, FIG. 9 shows a micro-projection light module with an actuator for displacing the exit optics in the vertical direction and with an actuator for displacing the exit optics in the horizontal direction, FIG. 10*a* shows a schematic light distribution, FIG. 10*b* shows the effects of a displacement of the exit optics vertically downwardly on the light distribution from FIG. 10*a*, FIG. 10*c* shows the effects of a displacement of the exit optics vertically upwardly on the light distribution from FIG. 10*a*, FIG. 11*a* shows a partial light distribution, produced with a light module according to the invention or one or more micro-optics systems of a light module of this kind, FIG. 11*b* shows the effects of a displacement of the exit optics horizontally to the left on the partial light distribution from FIG. 11*a*, FIG. 11*c* shows the effects of a further displacement of the exit optics horizontally to the left on the partial light distribution from FIG. 11*a*, FIG. 12 shows a schematic illustration of a lighting device, constructed from a plurality of micro-projection light modules according to the invention, FIGS. 13*a*-13*c* show different variants of micro-optics systems, and FIG. 14*a* and FIG. 14*b* show a schematic arrangement for producing a white total light distribution with use of light sources of different colours.

FIG. 1 schematically shows a micro-projection light module 1*s* for a vehicle headlight according to the prior art. The micro-projection light module 1*s* comprises a light source 2 and a projection arrangement 3*s*, which images the light emitted from the light source 2 into an area in front of the motor vehicle in the form of at least one light distribution. The shown coordinate system denotes the light exit direction Z, the horizontal direction H, which is normal to Z and normal to the vertical direction V. Here, the terms "horizontal" and "vertical" relate to the state of the micro-projection light module when installed in a vehicle headlight mounted in the vehicle.

The light source 2 is preferably a semiconductor-based light source, which for example comprises one, two, or more LEDs and/or laser diodes.

The light source 2 emits its light into an ancillary optics arrangement 4, for example a collimator, which directs the light of the light source 2 substantially in parallel before it impinges on the projection arrangement 3*s*.

This projection arrangement 3*s*, as shown in FIG. 1, comprises an entry optics 30 comprising an array of micro entry optics 31, and an exit optics 40 comprising an array of micro exit optics 41, wherein each micro entry optics 31 is paired with precisely one micro exit optics 41.

The micro entry optics 31 in a light module according to FIG. 1 are designed here in such a way and/or the micro entry optics 31 and the micro exit optics 41 are arranged relative to one another in such a way that the light exiting from a micro entry optics 31 enters precisely only the paired micro exit optics 41, and wherein the light pre-shaped by the micro entry optics 31 is imaged by the micro exit optics 41 into an area in front of the motor vehicle as at least one light distribution.

Furthermore, a first screen device 50 is arranged between the entry optics 30 and the exit optics 40. As will be explained further below in greater detail, the first screen device 50 can be used to trim the light flux passing through the projection arrangement so as to be able to produce one or more light distributions of defined form, for example having one or more light-dark boundaries.

For the sake of completeness, it should also be mentioned here that the illustration in FIG. 1 with the substantially dark first screen device 50 does not define the embodiment of the screen device 50 in any way. The illustration is purely schematic and is intended merely to indicate the presence of a first screen device 50 and the approximate position thereof.

The entry optics 30 is a single component formed by the micro entry optics 31 and formed separately from the ancillary optics arrangement 4. The micro entry optics 31 are arranged here directly adjacently, preferably without any distance, and form an array, as mentioned above and shown in FIG. 1.

It is also true that the exit optics 40 is a single component formed by the micro exit optics 41. The micro exit optics 41 are arranged here directly adjacently, preferably without any distance, and form an array, as mentioned above and shown in FIG. 1.

Reference is now made to FIG. 2, which schematically illustrates the essential components of a micro-projection light module 1 according to the invention and their relationship in a side view. The micro-projection light module 1 comprises a light source 2 and a projection arrangement 3, which images the light emitted from the light source 2 into an area in front of the motor vehicle in the form of at least one light distribution.

The light source 2, as before, is preferably a semiconductor-based light source, which for example comprises one, two, or more LEDs and/or laser diodes.

The light source 2 emits its light, as before, into an ancillary optics arrangement 4, for example a collimator, which directs the light of the light source 2 substantially in parallel, before it impinges on the projection arrangement 3.

As before, this projection arrangement 3 comprises an entry optics 30 consisting of an array of micro entry optics 31, and an exit optics 40 consisting of an array of micro exit optics 41, wherein each micro entry optics 31 is paired with precisely one micro exit optics 41. In contrast to the conventional projection arrangement 3*s* shown in FIG. 1, the entry optics 30 of the projection arrangement 3 of FIG. 2 comprises at least one planar boundary surface 31', wherein the planar boundary surface 31' faces the ancillary optics arrangement 4, which is preferably formed as a collimator. It should be noted at this juncture that the entry optics 30 in a further development of the invention is formed in one piece with the ancillary optics arrangement 4 (FIGS. 2*a* and 2*b*) or is fixedly connected to the ancillary optics arrangement 4. The light exiting from the ancillary optics arrangement 4 impinges on the at least one planar boundary surface 31' and in so doing irradiates preferably the entire planar boundary surface 31'.

In addition, the micro entry optics 31 in the case of a micro-projection light module 1 according to FIG. 2 are formed in such a way and/or the micro entry optics 31 and the micro exit optics 41 are arranged relative to one another in such a way that the light emitted from a micro entry optics 31 enters precisely only the paired micro exit optics 41, and wherein the light pre-shaped by the micro entry optics 31 is imaged by the micro exit optics 41 into an area in front of the motor vehicle in the form of at least one light distribution.

In a development of the present invention, as is shown in FIG. 2*a*, a first screen device 50 and/or a second screen device 60 are/is provided and are/is arranged between the entry optics 30 and the exit optics 40 formed from the micro exit optics 41, wherein the first screen device 50 is preferably arranged between the entry optics 30 and the second screen device 60. Here, as already mentioned above, the light flux passing through the projection arrangement 3 can be trimmed by the first screen device 50 so as to be able to produce one or more light distributions of defined form, for example having one or more light-dark boundaries. As will be explained in greater detail further below, the light distribution produced for example with use of the screen device 50 can be largely corrected by the second screen device 60. For example, the above-mentioned chromatic aberrations (longitudinal and/or lateral chromatic aberrations), which may lead to a discolouration of the light-dark boundary and may be perceived by the human eye to be uncomfortable and irritating, in the light pattern can be reduced.

It is therefore provided that the entry optics 30 is formed in one piece with or is fixedly connected to the ancillary optics arrangement 4 and that the exit optics 40 is formed in one piece with or is fixedly connected to the second screen device 60. This is shown in FIG. 2*b*. Here, it is quite conceivable that the projection arrangement does not comprise a second optional screen device 60, in which case the exit optics can be formed in one piece with or fixedly connected to the first screen device 50.

FIGS. 2*c* and 2*e* show a micro-optics system consisting of a micro entry optics 31 and an associated micro exit optics 41 in an exploded illustration, wherein the micro entry optics 31 has a curved boundary surface 30', which curved boundary surface 30' faces the micro exit optics 41. Here, the curvature of the boundary surface 30' is formed in such a way that the curved boundary surface 30' is curved in the light propagation direction, as shown in FIGS. 2*c* to 2*f*. FIGS. 2*c* and 2*e* also show part of the first screen device 50 and the second screen device 60 in the region between the two micro-optics 31, 41.

Under consideration of the micro-optics system from FIGS. 2*d* and 2*f*, it can be seen in FIG. 2*d* that the micro entry optics 31 focuses the light passing therethrough in the vertical direction into a micro-optics focal point F1, wherein the micro-optics focal point F1 is preferably coincident with the focal point of the micro-optics system consisting of micro entry optics 31 and micro exit optics 41. FIG. 2*d* thus shows light beams which are emitted from the ancillary optics arrangement 4, are directed preferably parallel to one another, and lie in a vertical plane (specifically the plane A-A from FIG. 2*c*), or the projection of light beams in this plane A-A.

The light beams emitted in parallel from the ancillary optics arrangement 4 are thus focused by the micro entry optics 31 in the micro-optics focal point F1, which lies before the paired micro exit optics 41 as considered in the direction of light emission.

As has already been mentioned in the introduction, it should be noted here again for the sake of completeness that reference is made here and generally within the scope of this entire disclosure at other points by way of simpler wording to a focusing "in a focal point". In fact however, i.e. in reality, the light beams are not focused in an individual focal point, but instead are imaged into a focal area containing said focal point. This focal area can be a focal plane, but this focal area generally is not planar and can also be "formed" in a curved manner on account of higher-order aberrations and corrections, which corrections must be taken into consideration, in addition to paraxial approximation, when considering the light propagation of light beams that form a large angle to the optical axis, i.e. the light beams are imaged in a curved area containing the focal point. Here, the curvature of the focal area leads to errors in the produced light distribution (see FIG. 3*a* and FIG. 3*b*).

Each micro-optics system thus has a focal point F1 which lies between the entry optics 30 and exit optics 40 and in which light of the associated micro entry optics 31 preferably is focused.

The micro exit optics 41 also has a focal point preferably coincident with the micro-optics focal point F1 and with the focal point of the micro entry optics 31 associated with the micro exit optics 41. Light is thus focused in the focal point F1 and then collimated accordingly in the vertical direction as it passes through the associated micro exit optics 41 and is projected into an area in front of the vehicle, as illustrated schematically in FIG. 2*d*.

FIG. 2*f* also shows the behaviour in the horizontal direction H, i.e. beams that lie in a horizontal plane, for example in the plane B-B from FIG. 2*e*, or the projection of beams into this plane are/is considered. As can be seen in FIG. 2*e*, each micro-optics system consisting of micro entry optics 31 and micro exit optics 41 widens the light passing therethrough in the horizontal direction. For this purpose, each micro-optics system focuses the light passing therethrough in the horizontal direction onto a focal point located after (in the light propagation direction) the micro exit optics 41. This focal point is preferably coincident with the focal point F2 of the corresponding micro exit optics 41. The light is thus widened in the horizontal direction in order to achieve the desired width of the partial light distributions of the individual micro-optics systems.

It should be noted again at this point that here an idealised optical system is described; in practice, both first and second optics of a micro-optics system are often embodied as free-form optics, whereby an imaging as described above in a focal area is provided. In addition, at least some SL of the light from a micro-optics system will exit between the micro entry optics 31 and the associated micro entry optics and will be scattered in a micro-optics system adjacent to the aforesaid micro-optics system (FIG. 2*d*). This thus leads to what is known as crosstalk between the micro-optics systems, whereby a defective light distribution (see 3*a*, 3*b*) is produced. Here, the optionally provided second screen device 60 can function as an aperture diaphragm, which can block the undesirable parts SL of the light causing the crosstalk and can thus cause the light from the shown micro entry optics 31 to enter exclusively the paired micro exit optics 41. A key feature of the above-described micro-optics systems lies in the fact that these widen the light passing therethrough in the horizontal.

The micro entry optics 31 are preferably formed accordingly as collecting optics, which collect light in the vertical and horizontal direction. Here, the micro entry optics 31 for example can be formed as free-form optics.

With reference to the curved boundary surfaces 30' of the micro entry optics 31, it should therefore be noted that the curvature of each curved boundary surface 30' has a minimum radius of curvature value, i.e. said minimum value should not be undershot. As already explained above, total reflections and consequently additional light losses are thus reduced or avoided.

Here, the micro entry optics 31 can have different minimum radius of curvature values. In addition, as can be inferred for example from FIGS. 2*d* and 2*f*, the boundary surfaces 30' of a micro entry optics 31 have different curvatures in the horizontal and vertical directions, wherein the radius of curvature of the boundary surface 30' in the vertical direction V (FIG. 2*d*) is preferably smaller than the radius of curvature of the boundary surface 30' in the horizontal direction H (FIG. 20. For example, this means that each micro entry optics focuses the light passing therethrough more weakly in the horizontal direction H than in the vertical direction V.

Furthermore, it is thoroughly conceivable that the boundary surfaces of the micro exit optics facing away from the micro entry optics 31 can be curved differently.

The micro exit optics 41 are usually formed as projection optics, for example as spherical or aspherical lenses. It can also be provided that the micro exit optics 41 are formed as free-form lenses.

Reference should be made briefly at this juncture to FIGS. 13*a* to 13*c*: in the description above and below, it is assumed that each micro entry optics 31 and each micro exit optics 41 is formed as a sole lens. However, it may also be that either the micro entry optics 31 and/or the micro exit optics 41 once again in each case consist/consists of one, two, or more "optics" or optical elements. Each of these "micro micro-optics elements" of a micro-optics must for this purpose have the same focal plane. By way of example, one or both micro-optics can be Fresnel lenses which have different optically effective regions. Each of the optical regions (micro micro-optics) of a micro entry optics can, but does not have to, irradiate light into each micro micro exit optics.

As can be inferred from FIGS. 2*a* and 2*c*, the boundary surfaces 31', 41', facing away from one another of paired micro entry optics 31 and micro exit optics 41 are formed congruently to one another, preferably in a planar manner, and are preferably also arranged congruently to one another.

In the shown example, the faces 31', 41' are square, however other shapes, for example rectangular or hexagonal faces, are quite conceivable.

The optical axes 310, 410 (FIGS. 2*c*, 2*e*) of paired micro entry optics 31 and micro exit optics 41 advantageously run parallel to one another, wherein it is advantageous in particular in respect of the adjustment of the projection arrangement 3 as a whole if the optical axes 310, 410 are coincident.

The first screen device 50 lies preferably in a plane spanned by the micro-optics focal points F1. Here, the screen device 50 for each micro-optics system (see FIG. 2*c*, 2*e*) preferably comprises a screen, wherein the screen has one or more optically effective screen edges.

The second screen device 60 lies between the first screen device 50 and the exit optics 40. Here, the second screen device 60 for each micro-optics system (see FIG. 2*c*, 2*e*) preferably comprises a screen, wherein the screen has one or more optically effective screen edges and is used to prevent the scattered light SL (FIG. 2*d*) from passing through.

FIGS. 2*c*, 2*e* show a micro-optics system paired with a first screen 52 having an optically effective screen edge 52' and with a second screen 62 having a further optically effective edge 62'. The light passing through this system is firstly trimmed in accordance with the first screen edge 52', and the screen edge 52' is imaged in the light pattern as a light-dark boundary. The light is also trimmed in accordance with the second screen edge 62' in such a way that there is no crosstalk between the individual micro-optics systems, and the aberrations Y1, Y2 of the light distribution GLV created by the curvature of the focal area (see FIG. 3*a*, 3*b*) are remedied.

The first screen device 50 and the second screen device 60 thus have a screen for at least one pair of paired micro entry and micro exit optics 31, 41. However, the first screen device 50 and the second screen device 60, preferably have a screen 51, 52, 53, 54, 55, 61, 62, 63, 64, 65 for a plurality of pairs, and in particular for all pairs, said screens having at least one, for example precisely one, optically effective screen edge 51', 52', 53', 54', 55', 61', 62', 63', 64', 65' respectively (FIG. 3 and FIG. 4).

The first screen device 50, known from the prior art, is shown schematically in FIG. 3. FIG. 3 shows this first screen device 50 in a view from the front, wherein the first screen device 50 has five different types of screens 51 to 55. Each of these screens 51 to 55 consists of a light-impermeable material 51", 52", 53", 54", 55", which comprises precisely one (as shown) or more (not shown) light-permeable apertures 51'", 52'", 53'", 55'", through which light can pass. The screen edges 51', 52', 53', 54', 55' of the screens are imaged in the corresponding partial light pattern as light-dark boundaries arranged at the top, which delimit the partial light image upwardly. It should be noted that the term "front" in conjunction with the present invention is based on the light propagation direction/primary emission direction of the micro-projection light module.

Each of these screens is paired with precisely one micro-optics system, and if all micro-optics systems are irradiated with light, a total light distribution GLV is produced, as shown schematically in FIG. 3*a*, as a superimposition of all partial light distributions. The shown total light distribution GLV in the shown example is a dipped beam distribution with asymmetric light-dark boundary.

FIG. 3*b* shows each of the screens 51-55 and, to the left, beside the screen, schematically shows the partial light distribution LV1-LV5 produced therewith.

Here, it can be clearly seen that aberration regions X1, X2, X3, X4, X5, X6 are created in the partial light distributions LV2, LV4, LV5 as a result of the aberrations and as a result of the crosstalk between adjacent micro-optics systems, the superimposition of said aberration regions leading to the creation of large aberration regions Y1, Y2 in the total light distribution GLV.

FIG. 4 shows a second screen device 60 according to the invention, with the aid of which aberrations are remedied. Here, the second screen device 60 is shown in a view from the front. Five different types of screens 61 to 65 can be seen and are comprised by the second screen device 60. Each of these screens 61 to 65 consists of a light-impermeable material 61", 62", 63", 64", 65", which has precisely one (as shown) or more (not shown) light-permeable apertures 61'", 62'", 63'", 64'", 65'", through which light can pass. The light pattern already trimmed with the aid of the first screen device is also trimmed by the apertures in such a way that there are no longer any aberration regions X1 to X6 present, and consequently also no large aberration regions Y1, Y2 in the produced partial light distributions and light distributions. This is achieved by the shaping of the screen edges. Here, a gable-like shape of the lower screen edge 62', 64', 65' of the screens, but generally rising from the centre outwardly at an incline, has proven to be particularly advantageous. These are imaged in the particular partial light pattern as upper light-dark boundaries, which delimit the light pattern upwardly. The light-impermeable regions 61" to 65" are formed here and designed in such a way that there is no crosstalk between the micro-optics systems, i.e. no scattered light SL (part SL of the light in FIG. 2*d*) passes from one micro-optics system into the adjacent micro-optics system. The aberration Y2 is thus reduced or remedied.

FIG. 4*a* shows each of the screens 61 to 65 and to the left, beside the screen, schematically shows the partial light distribution LV1' to LV5' produced therewith without aberration regions X1 to X6.

FIG. 5 shows a further exemplary embodiment of the second screen device 70. Compared with the second screen device 60 of FIGS. 4 and 4*a*, at least some of the screens 73*a* to 73*d* and 75*a* to 75*f* of the second screen device 70 of FIG. 5 have a light-permeable aperture 73*a*'" to 73*d*'" and 75*a*'" to 75*f*'". Here, the screens 73*a* to 73*d* and 75*a* to 75*f* are arranged in such a way that the light passing through their apertures 73*a*'" to 73*d*'" and 75*a*'" to 75*f*'" forms partial light distributions LV3" and LV5" (FIG. 5*a*), wherein the partial light distributions LV3" and LV5" contribute to an area in the middle of the total light distribution, i.e. around the desired maximum of the illumination intensity of the irradiated light distribution, in which area a greater illumination intensity is required, for example.

The embodiment of the second screen device 70 shown in FIG. 5 is particularly advantageous since, for example, the use of the second screen device 60 in accordance with FIG. 4 instead of the second screen device 70 according to FIG. 5 would mean that the majority of the light flux would be shaded and therefore for example would not satisfy legally prescribed light flux values in the LD point. The reason for this is that the light needed to produce the partial light distributions LV3 to LV5 is focused heavily in the focal area or intermediate image plane of the projection arrangement. The further beam propagation is then such that some of the light beams can form a large angle to the optical axis, and therefore the apertures 73*a*'" to 73*d*'" and 75*a*'" to 75*f*'" of the second screen device 70 have to be very large so that a sufficient amount of light passes through.

In this way, shown in FIGS. 4, 4*a*, 5 and 5*a*, an aberration-free dipped beam distribution for example can be produced using a light module according to the invention, wherein individual micro-optics systems each make a defined contribution to the aberration-free dipped beam distribution in the form of an aberration-free partial light distribution.

With light modules of this kind, any aberration-free total light distributions can also be produced. By illuminating, in groups, micro-optics systems with the first and the second screen with in each case at least one dedicated light source, predefined aberration-free partial light distributions (determined by the form of the screen edge) can be selectively activated (or masked out), such that a dynamic light distribution can be produced, for example.

The design of the one or more entry optics and exit optics allows only a limited shaping of the light distribution in some circumstances. Due to the use of preferably standardised screens as described above, one, two, or more partial light distributions can be produced, which, with appropriate selection, lead to the desired overall light distribution.

The screens can be embodied for example also as individual screens, which "form" the screen devices, however screen device components are preferably used, as shown, for example planar films, etc., in which corresponding openings/apertures are provided for the passage of light.

FIGS. 6*a* and 6*b* show a detail of the micro-projection light module according to the invention with four micro-optics systems arranged in each case in a 2×2 array. The first and the second screen device are arranged between the micro-optics systems. Here, FIG. 6*a* shows a three-part (note the one-piece embodiment of the second screen device 60, 70 with the exit optics 40) and FIG. 6*b* shows a four-part (entry optics 30, exit optics, the first screen device 50 and the second screen device 60, 70 are formed separately from one another) embodiment of the micro-projection light module.

In a variant, which is shown in FIG. 6*a*, it is provided that the entry optics 30, the first screen device 50, and the exit optics 40 formed in one piece with the second screen device 60, 70 are formed separately from one another and typically are also arranged at a distance from one another. Here, the entry optics 30 is formed as four micro entry optics 30*a*, 30*b*, 30*c*, 30*d* and the exit optics 40 is formed as four micro exit optics 40*a*, 40*b*, 40*c*, 40*d*. The number of micro entry and micro exit optics is irrelevant here. Each entry and exit optics can have a different number of micro-optics (see also FIG. 13*c*). Here, the micro entry optics can have different radii of curvature of their exit face facing the micro exit optics. The micro exit optics can in turn likewise have different radii of curvature of their exit face facing away from the micro entry optics.

The second screen device 60, 70 can be produced by vapour deposition of one of the boundary surfaces 41' or by application of an absorbing layer, which is then selectively removed again, for example by means of laser beam.

However, it may also be provided in this case that the second screen device 60, 70 is formed as a component formed separately from the exit optics 40, as is shown in FIG. 6*b*. In this case, the second screen device 60, 70 can be inserted in the form of a precise mask, for example made of metal (perforated mask, slotted mask, grid, etc.).

The variants shown in FIGS. 6*a* and 6*b* can of course be combined. For example, for reasons of adjustability of the projection arrangement 3 (distances between the focal planes, orientation of the optical axis, etc.), it can be advantageous to form the second screen device 60, 70 separately from the exit optics 40, but to form the first screen device 50 in one piece with the second screen device 60, 70. It is advantageous in respect of the sharpness of the light pattern if the first screen device 50 is arranged in the area which is spanned by the focal points of the micro-optics systems and which forms the focal area of the projection arrangement 3. Here, the light pattern is determined by the form of the first screen device 50 and is corrected by the second screen device 60, 70 and brought into an aberration-free state.

The entry and exit optics are formed separately from one another in accordance with the invention. Here, a positioning effort of the individual components is necessary during the assembly process, wherein it is advantageous if the individual components (as explained in greater detail further below) can be moved relative to one another.

FIGS. 7-9 show embodiments in which the exit optics 40 is mounted displaceably with respect to the entry optics 30. Here, the ancillary optics arrangement 4, the entry optics 30, the first screen device 50, the second lighting device 60, 70, and the exit optics 40 are formed separately from one another. However, in view of that said above, the embodiments in which for example the entry optics 30 is formed in one piece with or fixedly connected to the ancillary optics arrangement 4 and/or the second screen device 60, 70 is formed in one piece with or is fixedly connected to the exit optics 40 and/or the first screen device 50 are quite conceivably advantageous in some instances. For example, as mentioned above, a development of the present invention in which the ancillary optics arrangement 4 is formed in one piece with or fixedly connected to the entry optics 30 brings the advantage that light losses on account of reflections and/or total reflections are reduced by reducing the boundary surfaces between the optically relevant components.

The exit optics 40 is displaceable here (in the installed position of the micro-projection light module 1) in the vertical (FIG. 7), horizontal (FIG. 8) or vertical and horizontal (FIG. 9) direction. In this way, the light pattern can be displaced in the vertical and/or horizontal direction, for example for headlight range regulation and/or in order to provide a dynamic cornering beam function.

The exit optics 40 is displaced here preferably parallel to the entry optics 30, and/or parallel to the first screen device 50, and/or parallel to the second screen device 60, 70.

A separate actuator 140, 141 is provided in order to displace the exit optics 40 in each direction, wherein, in a specific embodiment, the at least one actuator 140, 140 is a piezoactuator. A typical path of movement for a piezoactuator of this type lies in the region of 100 μm (micrometres). In principle, however, other actuators having a path of movement of <1 mm (less than one millimetre) can also be used.

In order to achieve a uniform displacement of the entire light pattern, in which the light pattern per se therefore does not change, but instead only the position thereof, it is favourable if all micro-optics systems affected by the displacement, in particular the micro exit optics, have the same optical parameters, in particular are identical.

In addition, when designing the projection arrangement care should be taken to ensure that no light or only a small proportion of the light exiting from a micro entry optics enters into an unpaired micro exit optics, even in the event of a displacement of the exit optics. This proportion, as mentioned above, can be reduced with the aid of the second screen device.

However, it can also be provided that the micro-optics systems are formed differently in order to achieve a deliberate modification of the light pattern.

In the specific exemplary embodiment, a slight displacement of the imaging optics, i.e. the exit optics, for example by 0.03 mm, is sufficient for a displacement of the light pattern by 0.8°. By way of example, FIG. 10*a* shows a schematic light distribution, FIG. 10*b* shows the same light distribution following a displacement of the exit optics 40 vertically downwardly, and FIG. 10*c* shows the effects of the displacement of the exit optics 40 vertically upwardly on the light distribution. The form of the light distribution has not changed here or has only changed insignificantly, whereas the light distribution has shifted upwardly or downwardly.

A headlight range adjustment of approximately 2.5° can be achieved for example with a stroke of approximately 1 mm.

As a result of the displacement of the exit optics 40, the light pattern can additionally be distorted to a certain extent. When designing the system as a whole, it should be taken into account that these distortions must satisfy the legal and technical requirements. These distortions can likewise be reduced with the aid of the second screen device 60, 70.

FIG. 11*a* shows an exemplary partial light distribution produced with a micro-projection light module 1 according to the invention or one or more micro-optics systems of a micro-projection light module 1 of this kind, FIG. 11*b* shows the effects of a displacement of the exit optics 40 horizontally to the left on the partial light distribution from FIG. 11*a*, and FIG. 11*c* shows the effects of yet a further displacement of the exit optics 40 horizontally to the left on the partial light distribution. Here, FIG. 11*b* shows a displacement of the imaging exit optics 40 by approximately 0.1 mm, and FIG. 11*c* by approximately 0.2 mm.

As can be seen, a small displacement is sufficient to result in a noticeable displacement of the light pattern in the vertical and/or horizontal direction.

In the case of a conventional projection system having a projection lens, the lens has a typical diameter between 60 mm and 90 mm. In a micro-projection light module according to the invention the individual micro-optics systems typically have dimensions of approximately 2 mm×2 mm (in V and H accordingly) and a depth (in Z) of approximately 6 mm-10 mm, and therefore a much shorter depth of a micro-projection light module according to the invention is provided in the Z direction compared with conventional modules.

The micro-projection light modules according to the invention have a short overall depth and in principle can be formed freely, i.e. it is possible for example to embody a first micro-projection light module for producing a first partial light distribution separately from a second light micro-projection module for a second partial light distribution and to arrange these offset from one another relatively freely, i.e. vertically and/or horizontally and/or in depth, such that design specifications can also be easily realised A further advantage of a micro-projection light module according to the invention is that, although the projection arrangement has to be produced in a very accurate manner, which is possible however without difficulty by means of modern production methods, the exact positioning of the light source(s) relative to the projection optics is inapplicable for this. An exact positioning is only still of subordinate importance insofar as the at least one light source illuminates an entire array of micro entry optics which all produce substantially the same light pattern. In other words, this means merely that the "actual" light source is formed by the real light source(s) and the array of micro entry optics. This "actual" light source then illuminates the micro exit optics and where appropriate the paired screens. However, since the micro entry and micro exit optics are now already optimally adapted to one another, since these form a system so to speak, a non-exact positioning of the real light source (s) is of less consequence.

FIG. 12 shows a lighting device for a vehicle headlight comprising one, two, or more micro-projection light modules as have been described above. Here, a number of groups of different light modules are provided, for example FIG. 12 illustrates micro-projection light modules of the groups AA, AA1, AA2, SS1, BF1-BF8, FL, ABL, SA1, SA2, which jointly form the lighting device. Each group AA, AA1, AA2, SS1, BF1-BF8, FL, ABL, SA1, SA2 comprises one, two or more micro-projection light modules.

In the shown example each group comprises precisely on micro-projection light module, with these being listed hereinafter. Here:

AA designates a micro-projection light module for producing an asymmetrical dipped beam $LV_{AA}$ in the far field;

AA1, AA2 designates asymmetrical dipped beam $LV_{AA1}$, $LV_{AA2}$ in the far field in a cornering beam module SS1 designates a micro-projection light module for producing a symmetrical light distribution $LV_{SS1}$ (front-end of a dipped beam, town beam);

BF1 to BF8 designate micro-projection light modules for producing a glare-free full beam $LV_{BF1}$-$LV_{BF8}$; the individual light distributions $LV_{BF1}$-$LV_{BF8}$ produce jointly a full beam distribution or part thereof, the individual light distributions can be masked out independently of one another as required;

FL designates a micro-projection light module for producing a full beam $LV_{FL}$;

ABL designates a micro-projection light module for producing a turning beam $LV_{ABL}$;

SA1, SA2 designate micro-projection light modules for producing additional light components for preferably aberration-free motorway beam $LV_{SA1}$, $LV_{SA2}$.

It is advantageous in a lighting device of this kind when the light sources of each group of micro-projection light modules AA, AA1, AA2, SS1, BF1-BF8, FL, ABL, SA1, SA2 are controllable independently of the light sources of the other groups, such that the individual light distributions or partial light distributions can be switched on and off and/or dimmed independently of one another.

FIG. 12 is a purely schematic illustration, and reference is made to "micro-projection light modules" in conjunction with FIG. 12. In fact, FIG. 12 shows only and purely schematically the projection arrangements AA, AA1, AA2, SS1, BF1-BF8, FL, ABL, SA1, SA2 of the individual micro-projection light modules, and as can be seen in FIG. 12 the projection arrangements AA, AA1, AA2, SS1, BF1-BF8, FL, ABL, SA1, SA2 of the individual micro-projection light modules form a common component, for example in the form of a looped band. These projection arrangements can be arranged by way of example on a film.

The lens arrays can thus be formed freely from micro entry and micro exit optics with the present invention, and two or more micro-projection light modules according to the invention can also be combined via a common projection arrangement component to form a lighting device, wherein the micro-optics systems are formed identically in those regions of the projection arrangement component paired with a certain predefined micro-projection light module (and therefore an independently controllable light source).

FIGS. 13*a* to 13*c*, as already mentioned briefly above, also show some conceivable variants, combinations or other divisions of the micro-optics and the optionally provided screen devices.

FIG. 13*a* shows an example in which, in a micro-optics system, the micro entry optics 31 is formed as a Fresnel lens and the micro exit optics 41 is formed as a "conventional" lens.

FIG. 13*b* shows an example in which the micro entry optics 31 is formed as a "conventional" lens and the micro exit optics 41 is formed as a Fresnel lens.

FIG. 13*c* shows an example in which the micro entry optics 31 is formed as a "conventional" lens and the micro exit optics 41 is formed as an array of micro micro exit optics (micro micro-lenses). Here, both the shown detail of the first screen device 50 and the shown detail of the second screen device 60, 70 comprise a different number of screens. For example, it is quite conceivable that the detail of the first screen device 50 in FIG. 13*c* comprises just a single screen, wherein the detail of the second screen device 60, 70 comprises a plurality of screens, wherein each screen corresponds to a micro micro exit optics, and vice versa.

An important feature, which is shown in FIGS. 13*a* to 13*c*, is that the second screen device 60, 70 (when this screen device is provided), is arranged between the first screen device 50 (when provided) and the micro exit optics 41 in the light propagation direction and acts as an aperture diaphragm. The position of the second screen device 60, 70 in the beam path therefore is not freely selectable. The first screen device 50 is a field diaphragm/visual field diaphragm. Here, it is advantageous with regard to the light pattern quality to arrange the first screen device in the focal area or in the intermediate image plane of the micro-optics system.

FIG. 14*a* and FIG. 14*b* show two further embodiments. Here, it is provided that different regions, for example precisely three different regions, of micro-optics systems 3 are illuminated with light sources 2 of different colour R, G, B, for example one region is illuminated with red light R, another region is illuminated with green light G, and a third region is illuminated with blue light B.

The different regions can belong here to one projection arrangement 3 (FIG. 14*a*), but can also belong to different (two or more, for example three, as shown in FIG. 14*b*) projection arrangements or to one projection arrangement or to two or more, in particular three projection arrangements. It is merely important here that each region of micro-optics systems produces the same light distribution as the other regions. In order to be able to accept the above-described chromatic aberrations, it is provided in the case of the projection arrangement of FIG. 14*a* that the first screen device comprises three sub-screen devices 50R, 50G, 50B, wherein each sub-screen device is arranged in the focal area corresponding to the particular colour. The focal points of the micro-optics systems for the red light L thus lie further forward in the light propagation direction than the focal points of the micro-optics systems for the green light G, which in turn lie before the focal points of the micro-optical systems for the blue light B, as can be inferred from FIG. 14*a*.

The embodiment shown in FIG. 14*a* has the advantage that all light sources which irradiate light of different colours are paired with a single, preferably one-piece entry optics. Here, it can also be provided that the first screen device and/or the second screen device comprise/comprises three sub-screen devices, which can be used for correction of the chromatic aberrations.

The embodiment shown in FIG. 14*b* comprises three projection arrangements 3R, 3G, 3B, which can be formed in one piece with one another or separately from one another. Here, the first screen device 50 and the second screen device 60, 70 are provided. The projection arrangements differ from one another in the example by the form of the entry optics 30R, 30G, 30B, which are formed in such a way that the focal areas of the three projection arrangements 3R, 3G, 3B each corresponding to a light colour are coincident. This effect can be achieved for example by adaptation of the thickness and/or the curvature of the micro entry optics forming the entry optics. By changing the thickness and/or the curvature of the micro entry optics, the focal lengths of the micro-optics systems are changed, whereby the distance between the boundary surface 31' of the entry optics 30 and the focal area can be defined independently of the colour of the light R, G, B, as shown in FIG. 14*b*. The first screen device 50 of FIG. 14*b*, which is preferably formed in one piece, is arranged here in the coincident focal areas of the projection arrangements 3R, 3G, 3B. The embodiment shown in FIG. 14*b* has the advantage of great design freedom, which for example can be provided by three projection arrangements 3R, 3G, 3B formed separately from one another.

By superimposing the light patterns/light distributions from the different regions, a white, preferably aberration-free light pattern/a white, preferably aberration-free light distribution is then produced on the whole.

If laser light sources are used in this context as light sources, only a few micro-projection arrays (regions) are required to produce a white light distribution on account of the high luminous intensities of lasers, and therefore a smaller light module can be produced in the lateral direction.

The invention claimed is:

1. A micro-projection light module (1) for a vehicle headlight of a motor vehicle, comprising:

at least one light source (2) and at least one projection arrangement (3) which images the light emitted from the at least one light source (2) into an area in front of the motor vehicle in the form of at least one light distribution, wherein the at least one projection arrangement (3) comprises:

an entry optics (30) having one, two, or more micro entry optics (31) arranged in an array, and an exit optics (40) having one, two, or more micro exit optics (41) arranged in an array, wherein each micro entry optics (31) is paired with precisely one micro exit optics (41), wherein the micro entry optics (31) are configured, and/or the micro entry optics (31) and the micro exit optics (41) are together configured, such that substantially all the light emitted from a micro entry optics (31) enters precisely only into the paired micro exit optics (41), and wherein the light pre-shaped by the micro entry optics (31) is imaged by the micro exit optics (41) into an area in front of the motor vehicle in the form of at least one light distribution (LV1-LV5; GLV), wherein the at least one light source (2) is paired with an ancillary optics arrangement (4), the at least one light source (2) irradiates the light emitted therefrom into said at least one ancillary optics arrangement (4), said ancillary optics arrangement (4) being configured such that the light emitted therefrom is directed substantially in parallel, and the entry optics (30) having at least one planar boundary surface (31'), wherein the at least one planar boundary surface (31') faces the ancillary optics arrangement (4), and wherein at least one first screen device (50) and at least one second screen device (60, 70) are arranged between the entry optics (30) and the exit optics (40), the at least one first screen device (50) comprising a screen having at least one optically effective screen edge (51', 52', 53', 54', 55').

2. The micro-projection light module according to claim 1, which is configured such that the light emitted from the ancillary optics arrangement (4) impinges on the at least one planar boundary surface (31').

3. The micro-projection light module according to claim 1 which is configured such that the light emitted from the ancillary optics arrangement (4) irradiates substantially the entire planar boundary surface (31').

4. The micro-projection light module according to claim 1, wherein the ancillary optics arrangement (4) is formed as a collimator.

5. The micro-projection light module according to claim 1, wherein the ancillary optics arrangement (4) is formed in one piece with the entry optics (30).

6. The micro-projection light module according to claim 1, wherein a micro entry optics (31) and a micro exit optics (41) paired with the micro entry optics (31) form a micro-optics system, which micro-optics system comprises at least one micro-optics focal point (F1) and/or widens the light passing therethrough in the horizontal direction.

7. The micro-projection light module according to claim 6, wherein the micro entry optics (31) focuses the light passing therethrough in the at least one micro-optics focal point (F1).

8. The micro-projection light module according to claim 6, wherein a micro-optics focal point (F1) of each micro entry optics (31) lies before the paired micro exit optics (41) in the light emission direction, wherein the micro entry optics (31) focus the light passing therethrough in the vertical direction in each case onto the micro-optics focal points (F1) lying before the micro exit optics (41), and wherein the micro exit optics (41) have a focal point coincident in each case with the micro-optics focal point (F1) of the paired micro entry optics (31).

9. The micro-projection light module according to claim 1, wherein each micro entry optics (31) has a curved boundary surface (30'), which curved boundary surface (30') has a minimum radius of curvature value ($R_{min}$).

10. The micro-projection light module according to claim 1, wherein each micro entry optics (31) is formed as a collecting optics or as a free-form optics or as a Fresnel lens and/or each micro exit optics (41) is formed as a projection optics or as a spherical lens or as in a spherical lens or as a free-form lens or as a Fresnel lens.

11. The micro-projection light module according to claim 1, wherein boundary surfaces (31', 41') of micro entry optics (31) and micro exit optics (41) paired with one another facing the ancillary optics arrangement (4) are formed congruently with one another.

12. The micro-projection light module according to claim 11, wherein the boundary surfaces (31', 41') of the micro entry optics (31) and the micro exit optics (41) are arranged congruently with one another in a planar manner.

13. The micro-projection light module according to claim 1, wherein the optical axes (310, 410) of micro entry optics (31) and micro exit optics (41) paired with one another run parallel to one another.

14. The micro-projection light module according to claim 13, wherein the optical axes (310, 410) of the micro entry optics (31) and the micro exit optics (41) are coincident.

15. The micro-projection light module according to claim 1, wherein the at least one first screen device (50) lies in a plane spanned by the micro-optics focal points (F1).

16. The micro-projection light module according to claim 15, wherein the at least one second screen device (60, 70) is arranged between the at least one first screen device (50) and the exit optics (40) or between the entry optics (30) and the at least one first screen device (50).

17. The micro-projection light module according to claim 16, wherein:

the at least one second screen device (60, 70) for at least one pair of micro entry and micro exit optics (31, 41) paired with one another, for a plurality of pairs, comprises at least one screen (61 to 65, 71 to 75) having precisely one optically effective screen edge (61' to 65', 71' to 75'), wherein (i) all screens of the at least one second screen device (60, 70) have identical screen edges, or (ii) at least two screens of the at least one second screen device (60, 70) have screen edges of different design, wherein (a) the at least one optically effective screen edge (61' to 65', 71' to 75') has a gable-like course and/or (b) at least one upper or one lower (with respect to the vertical direction (V)) optically effective screen edge (61' to 65', 71' to 75') of the at least one screen (61 to 65, 71 to 75) has a sloping course, rising from the optical axis (310, 410) outwardly towards the at least one screen.

18. The micro-projection light module according to claim 16, wherein the at least one first screen device (50) and the at least one second screen device (60) are identical and/or the at least one first screen device (50) is formed in one piece with the at least one second screen device (60, 70).

19. The micro-projection light module according to claim 16, wherein the exit optics (40) is formed in one piece with the at least one second screen device (60, 70) and/or the at least one second screen device (60, 70) is arranged on the boundary surface (40') of the exit optics (40) facing the entry optics (30).

20. The micro-projection light module according to claim 15, wherein for at least one pair of the micro entry and the micro exit optics (31, 41) paired with one another, the at least one screen has precisely one optically effective screen edge (51', 52', 53', 54', 55').

21. The micro-projection light module according to claim 1, wherein the projection arrangement (3) consisting of entry optics (30) and exit optics (40) is formed of two components separated from one another and the exit optics (40) is mounted displaceably in relation to the entry optics (30), wherein the exit optics (40) and/or the at least one second screen device (60, 70) (in the installed position of the micro-projection light module (1)) are/is displaceable in the vertical and/or horizontal direction and/or parallel to the entry optics (30).

22. The micro-projection light module according to claim 1, wherein the light source (2) comprises at least one semiconductor-based light source, which semiconductor-based light source has one, two or more LEDs and/or laser diodes.

23. The micro-projection light module according to claim 22, wherein the LEDs and/or laser diodes are configured to be controlled independently of one another.

24. The micro-projection light module according to claim 1, which comprises two or more light sources for the micro-projection light module (1), and the light sources can be controlled independently of one another.

25. The micro-projection light module according to claim 1, wherein each micro-optics system consisting of a micro entry optics (31) and a micro exit optics (41) is paired with precisely one semiconductor-based light source, which comprises precisely one light-emitting diode (LED) or precisely one laser diode.

26. The micro-projection light module according to claim 1, wherein two or more light source groups are provided, wherein each light source group comprises at least one light source (2), and wherein the light sources (2) of a light source group emit light of the same colour (R, G, B), and wherein the light sources of different light source groups emit light of different colour (R, G, B), and wherein each light source group illuminates a region (3R, 3G, 3B) of the at least one projection arrangement paired specifically with this light source group, and wherein the different regions (3R, 3G, 3B) are of identical design or are designed to produce identical light distributions, wherein three light source groups are provided, wherein in particular one light source group emits red light, one light source emits green light, and one light source group emits blue light.

27. A lighting device for a vehicle headlight, comprising one, two, or more micro-projection light modules (1) according to claim 1.

28. The lighting device according to claim 27, comprising:

two or more groups of the micro-projection light modules (AA, AA1, AA2, SS1, BF1-BF8, FL, ABL, SA1, SA2), wherein each group comprises one, two, or more micro-projection light modules (1), wherein the micro-projection light modules (AA, AA1, AA2, SS1, BF1-BF8, FL, ABL, SA1, SA2) of one of the two or more groups produces the same light distribution ($LV_{AA}$, $LV_{AA1}$, $LV_{AA2}$, $LV_{SS1}$, $LV_{BF1}$-$LV_{BF8}$, $LV_{FL}$, $LV_{ABL}$, $LV_{SA1}$, $LV_{SA2}$), and wherein the micro-projection light modules (AA, AA1, AA2, SS1, BF1-BF8, FL, ABL, SA1, SA2) from others of the two or more groups produce different light distributions ($LV_{AA}$, $LV_{AA1}$, $LV_{AA2}$, $LV_{SS1}$, $LV_{BF1}$-$LV_{BF8}$, $LV_{FL}$, $LV_{ABL}$, $LV_{SA1}$, $LV_{SA2}$), wherein the light sources of each group of the two or more groups can be controlled independently of the light sources of others of the two or more groups.

29. The lighting device according to claim 28, wherein projection arrangements (3) of the micro-projection light modules (AA, AA1, AA2, SS1, BF1-BF8, FL, ABL, SA1, SA2) form a common component.

30. The lighting device according to claim 28, wherein two or more of the groups are configured to produce a different light distribution ($LV_{AA}$, $LV_{AA1}$, $LV_{AA2}$, $LV_{SS1}$, $LV_{BF1}$-$LV_{BF8}$, $LV_{FL}$, $LV_{ABL}$, $LV_{SA1}$, $LV_{SA2}$), wherein each group forms a different light distribution ($LV_{AA}$, $LV_{AA1}$, $LV_{AA2}$, $LV_{SS1}$, $LV_{BF1}$-$LV_{BF8}$, $LV_{FL}$, $LV_{ABL}$, $LV_{SA1}$, $LV_{SA2}$), selected from one of the following light distributions ($LV_{AA}$, $LV_{AA1}$, $LV_{AA2}$, $LV_{SS1}$, $LV_{BF1}$-$LV_{BF8}$, $LV_{FL}$, $LV_{ABL}$, $LV_{SA1}$, $LV_{SA2}$):

turning beam light distribution;
town beam light distribution;
country road beam light distribution;
motorway beam light distribution;
light distribution for additional light for motorway beam;
cornering beam light distribution;
dipped beam light distribution;
dipped beam front-end light distribution;
light distribution for asymmetrical dipped beam in the far field;
light distribution for asymmetrical dipped beam in the far field in cornering beam mode;
full beam light distribution; and
glare-free full beam light distribution.

31. The lighting device according to claim 27, comprising two or more of the micro-projection light modules, wherein each micro-projection light module has at least one light source group, wherein each light source group comprises at least one light source, and wherein light sources in the same light source group emit light of the same colour (R, G, B), and wherein at least two light source groups are provided which emit light of different colours, and wherein each light source group illuminates a region (3R, 3G, 3B) of the at least one projection arrangement of its micro-projection light module paired in a dedicated manner with this light source group, and wherein the different regions (3R, 3G, 3B) are identical, or are configured for the production of identical light distributions, wherein three groups of light source groups are provided, wherein in particular one group of light source groups emits red light, one group of light source groups emits green light, and one group of light source groups emits blue light, and wherein each group of light source groups comprises at least one light source group.

32. A vehicle headlight comprising one or more lighting devices according to claim 27.

* * * * *